US010337180B2

(12) United States Patent
Smith et al.

(10) Patent No.: US 10,337,180 B2
(45) Date of Patent: Jul. 2, 2019

(54) LOW FLUSH TOILET SYSTEM

(71) Applicant: OT LLC, Sunfish Lake, MN (US)

(72) Inventors: Andrew Nathaniel Smith, Shoreview, MN (US); Tyler Lorne Hebig, Wayzata, MN (US); Paul Michael Goudreau, Edina, MN (US); Michael Wade Strawn, Minneapolis, MN (US)

(73) Assignee: OT LLC, Sunfish Lake, MN (US)

( * ) Notice: Subject to any disclaimer, the term of this patent is extended or adjusted under 35 U.S.C. 154(b) by 0 days.

(21) Appl. No.: 15/704,281

(22) Filed: Sep. 14, 2017

(65) Prior Publication Data

US 2018/0073231 A1 Mar. 15, 2018

Related U.S. Application Data

(60) Provisional application No. 62/394,618, filed on Sep. 14, 2016.

(51) Int. Cl.

| | |
|---|---|
| ***E03D 3/10*** | (2006.01) |
| ***E03D 1/28*** | (2006.01) |
| *E03D 9/16* | (2006.01) |

(52) U.S. Cl.

CPC ..... *E03D 1/283* (2013.01); *E03D 3/10* (2013.01); *E03D 9/16* (2013.01)

(58) Field of Classification Search

CPC .... E03D 3/10; E03D 3/12; E03D 1/30; E03D 1/302; E03D 1/304; E03D 1/306; E03D 1/308

USPC ..... 4/415

See application file for complete search history.

(56) References Cited

U.S. PATENT DOCUMENTS

| | | | | |
|---|---|---|---|---|
| 3,029,443 | A * | 4/1962 | Naccarato | E03D 3/10 4/362 |
| 4,142,262 | A * | 3/1979 | Hamilton | E03D 3/10 4/354 |
| 4,984,311 | A | 1/1991 | Bastile et al. | |
| 5,848,441 | A * | 12/1998 | Smith | E03D 1/186 4/334 |
| 6,470,505 | B1 * | 10/2002 | Boisvert | E03D 3/10 4/322 |
| 2003/0061652 | A1 | 4/2003 | Fish | |
| 2006/0107451 | A1 | 5/2006 | Kuster et al. | |
| 2009/0144889 | A1 | 6/2009 | Hennessay | |
| 2010/0050330 | A1 * | 3/2010 | Earlywine | E03D 3/10 4/321 |

(Continued)

OTHER PUBLICATIONS

International Search Report of International Application No. PCT/US2017/051528, dated Dec. 20, 2017, 3 pages.

*Primary Examiner* — Janie M Loeppke
(74) *Attorney, Agent, or Firm* — Holland & Hart, LLP

(57) ABSTRACT

The disclosed technology includes low flush toilet systems and methods of using low flush toilet systems. In one implementation, a low flush toilet system includes a first (or passive) tank, the first tank configured to preload a toilet rim, and a second (or pressurized) tank, the second tank including an internal air bladder, the internal air bladder configured to compress when exposed to water pressure from a supply line and configured to expand when a flush valve releases pushing water out of the second tank at a high flow rate and into a toilet for flushing. In some implementations, water flows from the pressurized tank at approximately 0.7-1.0 gallons per flush.

20 Claims, 23 Drawing Sheets

(56) References Cited

U.S. PATENT DOCUMENTS

2013/0312173 A1 11/2013 Li

* cited by examiner

LOW FLUSH TOILET SYSTEM

CROSS-REFERENCE TO RELATED APPLICATIONS

The present application claims benefit of priority to U.S. Provisional Patent Application No. 62/394,618 entitled "Low Flush Toilet System" and filed on Sep. 14, 2016, which is specifically incorporated by reference for all that it discloses or teaches.

BACKGROUND

Toilets are a top water consuming appliance in residential and commercial buildings. Certain toilet systems include designs that require a large amount of water to flush a toilet bowl, and in some cases, require more than one flush to clear waste from the toilet bowl. Such toilet systems are neither environment-friendly nor economical.

Due to water shortages and water conservation efforts, water efficiency standards have been implemented through various state legislation. For example, in some states, maximum flow rates have been implemented. Low-flush (or high-efficiency) toilet systems use significantly less water than high-flush toilet systems and can reduce water consumption.

SUMMARY

The disclosed technology includes low flush toilet systems and methods of using low flush toilet systems. In one implementation, a low flush toilet system includes a first tank, the first tank configured to preload a toilet, and a second tank, the second tank including an internal air bladder, the internal air bladder configured to compress when exposed to water pressure from a supply line and configured to expand when a flush valve releases pushing water out of the second tank at a high flow rate and into a toilet for flushing.

This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter. These and various other features and advantages will be apparent from a reading of the following Detailed Descriptions.

BRIEF DESCRIPTIONS OF THE DRAWINGS

DETAILED DESCRIPTIONS

The disclosed technology includes pressure assist toilet flushing systems and methods. Specifically, in one implementation, a two-tank configuration (e.g., a gravity tank and a pressure tank) can be applied to an existing toilet system and configured to perform a syphoning flush that uses less water than other pressure-assisted tanks due to a preloading operation of the flushing rim.

In some implementations, the pressure tank may be nested inside of the gravity tank. Further, the pressure tank and the gravity tank may be separate components. Once filled with water from a water supply, the gravity tank is released via the flushing rim of a toilet. The pressure tank includes an internal air bladder oriented within the pressure tank that compresses with incoming water supply pressure. Once the gravity tank has discharged via the flushing rim, the pressure tank is discharged by force of gravity The pressure built up in the pressure tank around a compressed bladder propels the water out of the pressure tank at a higher flow rate than the gravity tank. The compressed bladder expands to discharge the pressurized water of the pressure tank pushing the preloaded water into the toilet discharge trap, and creating a syphon that draws waste-filled water from the toilet bowl.

As the gravity tank is discharged via the flushing rim prior to discharging the pressure tank, the transfer of the high flow rate from the pressure tank to the discharge trap is much more efficient. For purposes of this disclosure, a "high flow" rate may be defined as water may flow from the pressure tank at approximately 0.7-1.0 gallons per flush (GPF). In some implementations, the pressure assist toilet flushing system may be compatible with a ⅜ inch or greater water supply line with standard water pressure.

Figure 1:
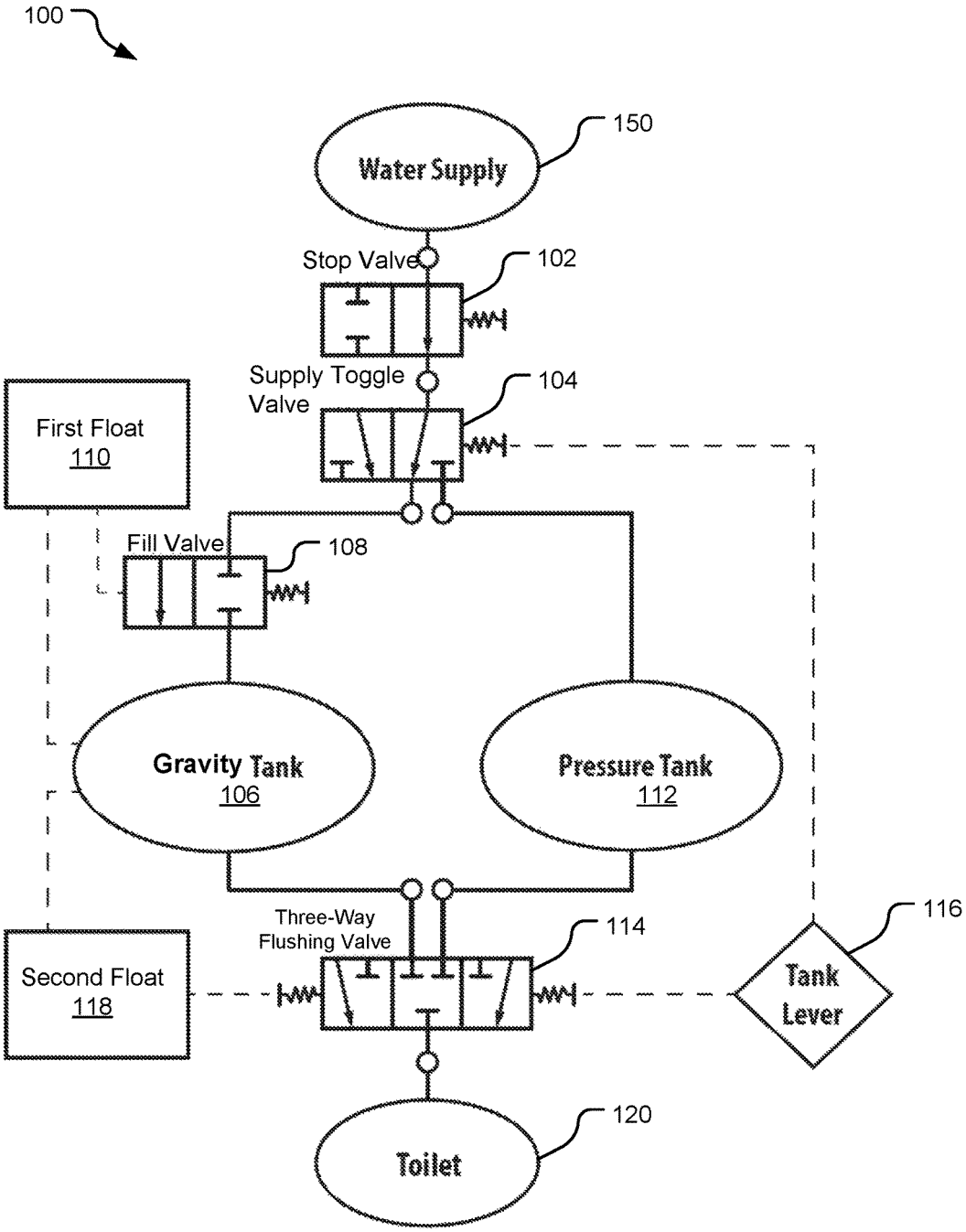
FIG. 1 illustrates a schematic diagram of an example low flush toilet system.

FIG. 1 illustrates a schematic diagram of an example low flush toilet system 100. For purposes of this disclosure, the term "low flush" may be defined as 1.28 gallons per flush (GPF). FIG. 1 shows the flow of water from a water supply 150 to a toilet bowl 120. Specifically, water flows from the water supply 150 through a stop valve 102 and then to a supply toggle valve 104. In some implementations, water flows from the water supply at approximately 30-40 psi.

Depending on the position of the supply toggle valve 104, the water may be directed to either a gravity tank 106 or a pressure tank 112. The gravity tank 106 stores the water at atmospheric pressure, while the pressure tank 112 is pressurized (e.g., at the water supply pressure). The supply toggle valve 104 may be automatically activated based on relative state of fill of the tanks 106, 112, or may be manually activated by a user through a tank lever 116. In an example implementations, the supply toggle valve 104 is open to the gravity tank 106 when the gravity tank 106 is below a maximum state of fill. Once the gravity tank 106 reaches its maximum state of fill, the supply toggle valve 104 switches to fill the pressure tank 112. In other implementations, the pressure tank 112 is filled before the gravity tank 106. The tank lever 116 is provided as an example and encompasses any sort of manual user input (e.g., a lever, a button, etc.).

When the supply toggle valve 104 is positioned so that the water is directed into the pressure tank 112, the water compresses an internal air bladder (e.g., shown in and described with regard to FIG. 2) inside the pressure tank 112. When the supply toggle valve 104 is positioned so that the water is directed into the gravity tank 106, the water passes through a fill valve 108. The fill valve 108 closes when the gravity tank 106 is filled to a predetermined level (e.g., a maximum state of fill). A first float 110 (e.g., a float) activates the fill valve 108 when the gravity tank 106 is full.

In FIG. 1, a three-way flushing valve 114 is also shown. The three-way flushing valve 114 may be normally closed, but can be actuated by either the tank lever 116 or an second float 118. When the three-way flushing valve 114 is actuated by the tank lever 116, the three-way flushing valve 114 will change positions from closed to open, and discharge the contents of the gravity tank 106 into the toilet bowl 120. In some implementations, the tank lever 116 actuates both the three-way flushing valve 114 and the supply toggle valve 104, connecting the water supply 150 to the toilet bowl 120 via the gravity tank 106. In other implementations, the supply toggle valve 104 is not actuated by the tank lever 116 and may remain open to the pressure tank 112 as the gravity tank 106 is discharged.

When the gravity tank 106 is discharged, the second float 118 actuates the three-way flushing valve 114 to close the discharge path from the gravity tank 106 and open a discharge path from the pressure tank 112, which permits the pressurized water within the pressure tank 112 to discharge from the pressure tank 112 to the toilet bowl 120. More specifically, the second float 118 may actuate the three-way flushing valve 114 when the water level in the gravity tank 106 is approximately empty to ensure that the pressure tank 112 is opened automatically when the gravity tank 106 has emptied to further discharge into the toilet bowl 120 (e.g., via a flushing rim, as shown and described with reference to FIG. 3).

Figure 2:
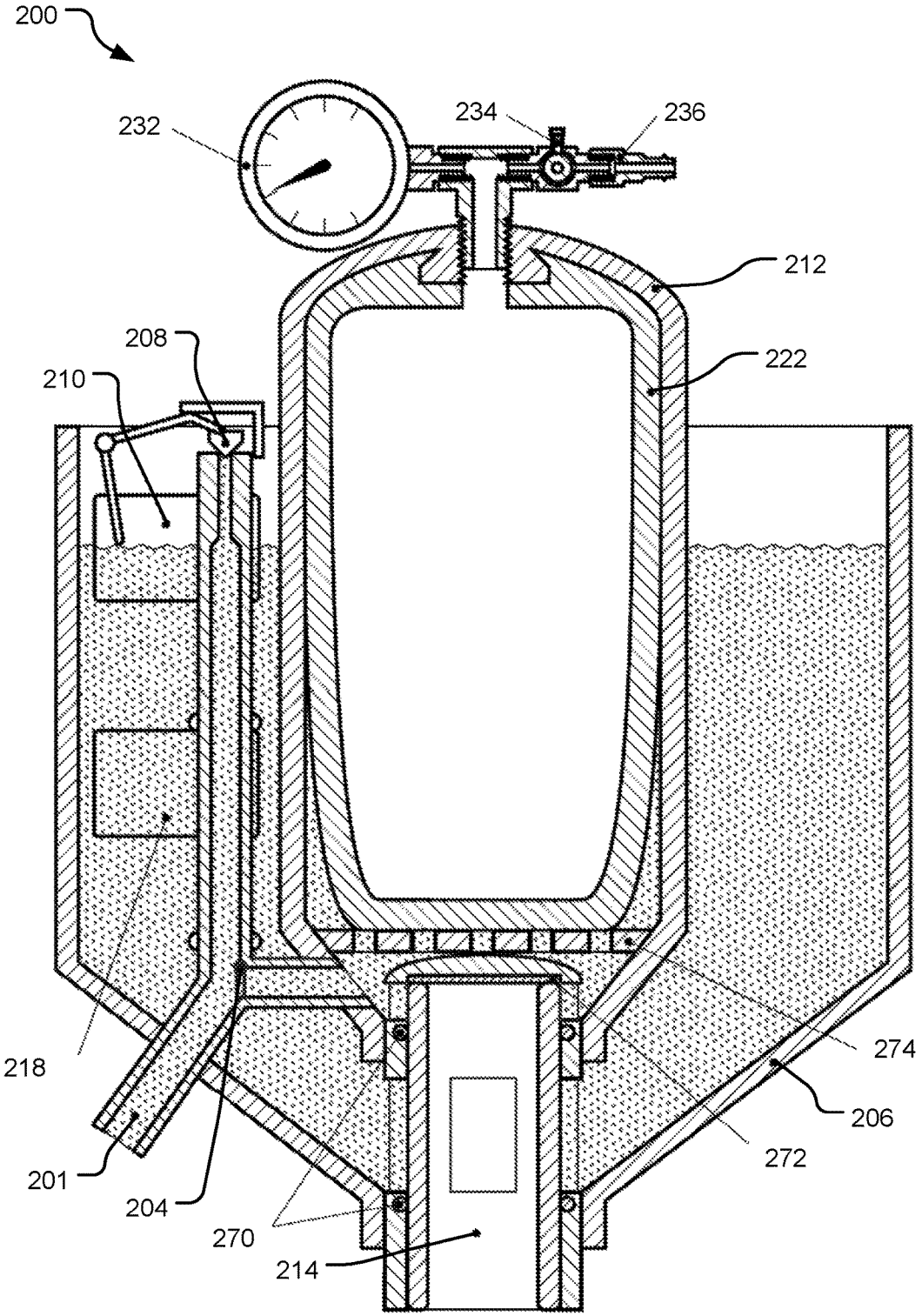
FIG. 2 illustrates a cross-sectional front view of an example low flush toilet tank system in a neutral state.
Figure 3:
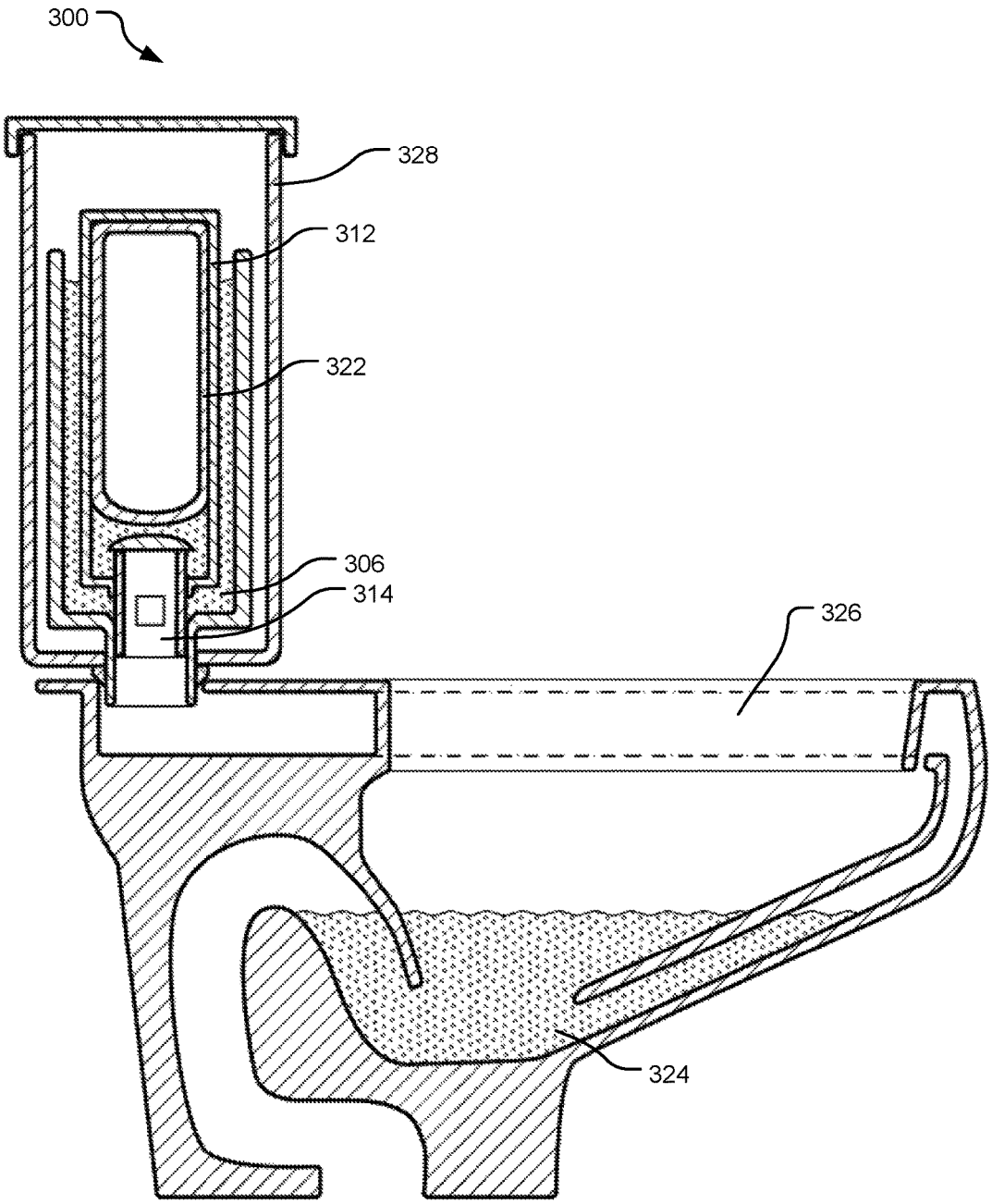
FIG. 3 illustrates a cross-sectional side view of an example low flush toilet system in a neutral state.

FIG. 2 illustrates a cross-sectional front view of an example low flush toilet tank system 200 in a gravity-filled state. More specifically, both a fill valve 208 and a flush valve 214 are oriented in a closed position. A supply toggle valve 204 is positioned so that the water supply 201 connects to the gravity tank 206. The gravity tank 206 is filled with a volume of water sufficient the fill and discharge via a flushing rim of an attached toilet bowl (not shown). As the gravity tank 206 is nearly filled, a inlet float valve 210 is rising and will soon trigger the supply toggle valve 204 to close water supply 201 from the gravity tank 206 and open the water supply 201 to the pressure tank 212 (as illustrated in FIG. 3). In various other implementations, the supply toggle valve 204 may be manually actuated.

The internal air bladder 222 inside the pressure tank 212 is at an initial pressure lower than the water pressure from the water supply 201, as it has not yet been filled. For example, the pressure from a water supply (not shown) may be approximately 30-40 psi, and the pressure on an internal air bladder 222 may be approximately 15-20 psi. The internal air bladder 222 compresses during a subsequent fill stage (see e.g., FIG. 3).

As shown in FIG. 2, the low flush toilet system 200 may also include a pressure gauge 232 to monitor the pressure in the pressure tank 212, a ball valve 234 to selectively open the internal air bladder 222 is atmosphere (or a separate compressor, not shown), and a compressor quick connect 236. The low flush toilet system 200 may also include a grate 274 below the internal air bladder 222 that provides structural support for the internal air bladder 222, while permitting water to pass through the grate 274 during filling and/or discharging the pressure tank 212. The low flush toilet system 200 may further include a set of o-rings (e.g., o-rings 270) and/or gaskets (e.g., gasket 274) that provide various sealing functions between the components of the low flush toilet system 200.

FIG. 3 illustrates a cross-sectional side view of an example low flush toilet system 300 in a gravity-filled state. An external tank 328 houses the pressure tank 312 and the gravity tank 306. Both a fill valve 308 (not shown) and a flush valve 314 are oriented in a closed position. A supply toggle valve (not shown) is positioned so that the water supply (not shown) connects to the gravity tank 306. The gravity tank 206 is filled with a volume of water sufficient the fill and discharge via a flushing rim of an attached toilet bowl (not shown). As the gravity tank 306 is nearly filled, the inlet float valve (not shown) is rising and will soon trigger the supply toggle valve to close the water supply off from the gravity tank 206 and open the water supply to the pressure tank 312. In various other implementations, the supply toggle valve may be manually actuated. The internal air bladder 322 inside the pressure tank 312 is at an initial pressure lower than the water pressure from the water supply, as it has not yet been filled. For example, the pressure from a water supply (not shown) may be approximately 30-40 psi, and the pressure on an internal air bladder 322 may be approximately 15-20 psi. The internal air bladder 322 compresses during a subsequent fill stage. The toilet bowl 324 is also filled with water during the gravity-filled state.

Figure 4:
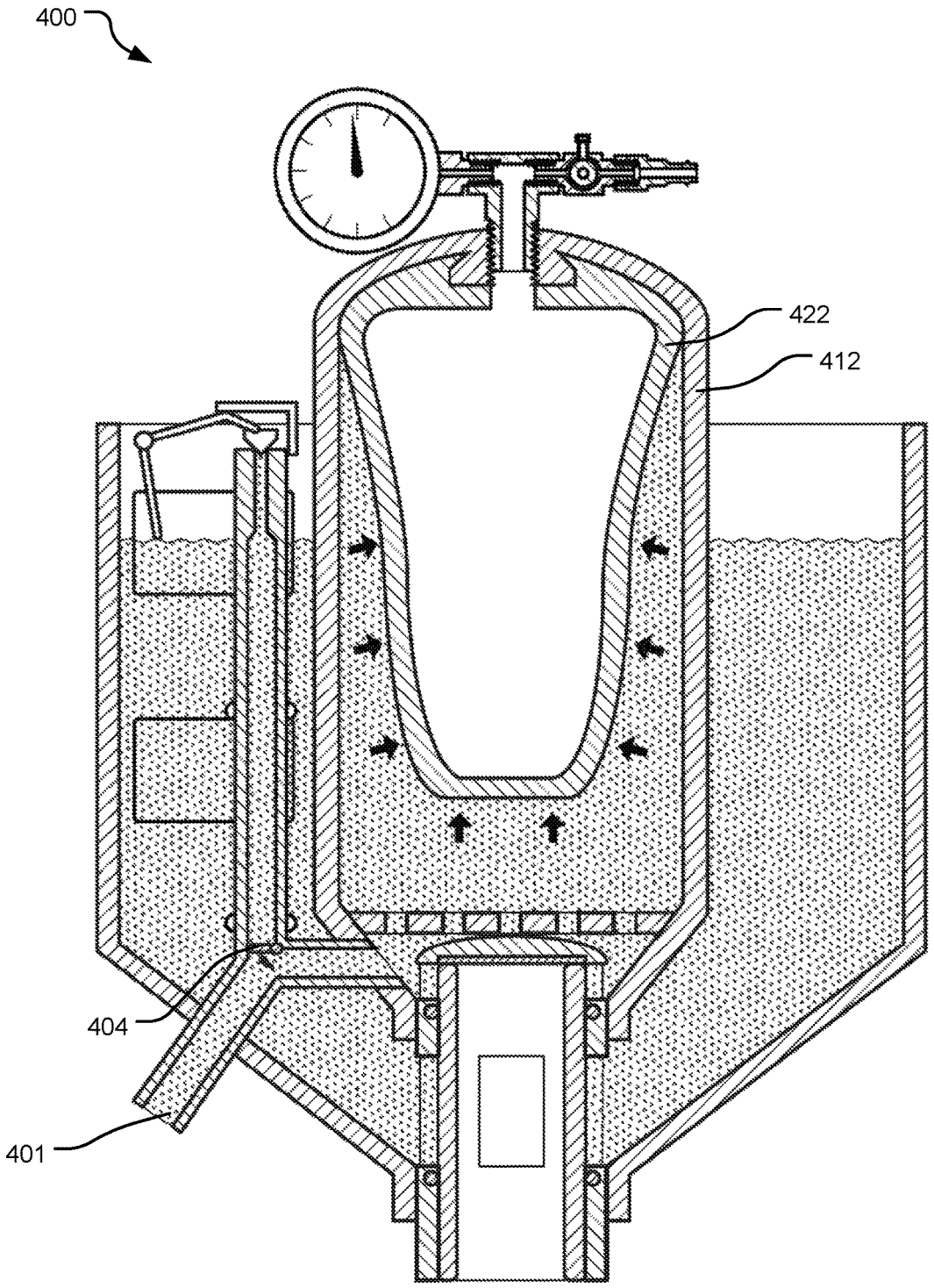
FIG. 4 illustrates a cross-sectional front view of an example low flush toilet tank system during a pressurization stage.

FIG. 4 illustrates a cross-sectional front view of an example low flush toilet tank system 400 during a pressurization stage. In some implementations, the pressurization state is automatically triggered when the gravity tank (see gravity tank 206 in FIG. 2) is filled. In other implementations, a user activates a tank lever (not shown), which in turn actuates the supply toggle valve 404 so that the water supply 401 is directed into the pressure tank 412. More specifically, a fill valve 408 is opened while a flush valve 414 remains in a closed position. A supply toggle valve 404 is actuated so that the water supply 401 connects to the pressure tank 422.

The pressure tank 412 is filled with a volume of water sufficient the fill and discharge via a flushing rim of an attached toilet bowl (not shown). As the pressure tank 412 is filled, the internal air bladder 422 is compressed (as illustrated by black arrows). The pressure tank 412 is completely filled when the internal air pressure of the internal air blader 422 equals the supply water pressure, and/or when the supply toggle valve 404 disconnects the pressure tank 422 from the water supply 401. Additionally, the three-way flushing valve 414 closes the pressure tank 412 off from the flushing rim (not shown).

Figure 5:
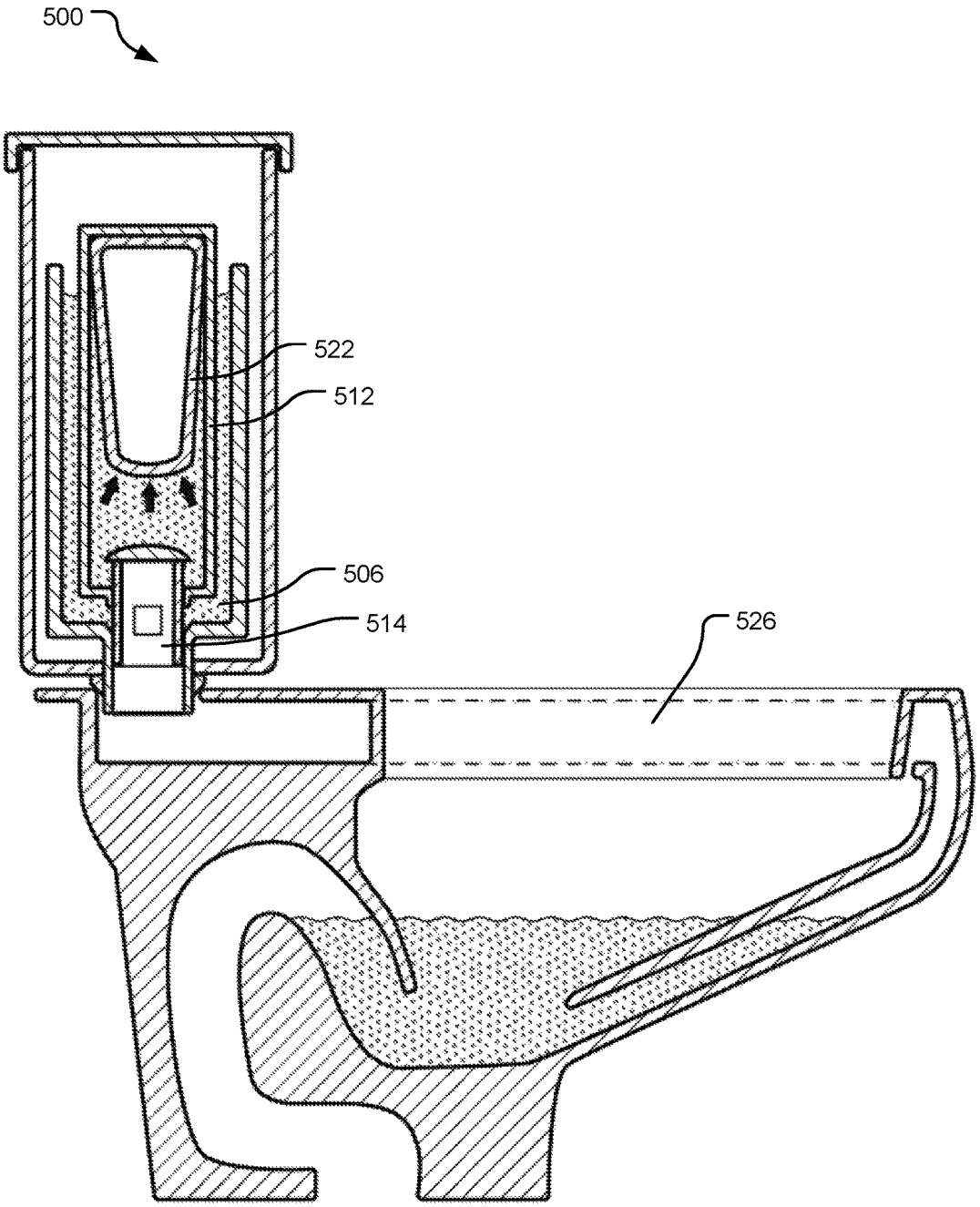
FIG. 5 illustrates a cross-sectional side view of an example low flush toilet system during a pressurization stage.

FIG. 5 illustrates a cross-sectional side view of an example low flush toilet system 500 during a pressurization stage. In some implementations, the pressurization state is automatically triggered when the gravity tank 506 is filled. In other implementations, a user activates a tank lever (not shown), which in turn actuates the supply toggle valve (not shown) so that the water supply (not shown) is directed into the pressure tank 512. More specifically, a fill valve (not shown) is opened while a flush valve 514 remains in a closed position. The supply toggle valve is actuated so that the water supply connects to the pressure tank 512.

The pressure tank 512 is filled with a volume of water sufficient the fill and discharge via a flushing rim of an attached toilet bowl (not shown). As the pressure tank 512 is filled, the internal air bladder 522 is compressed (as illustrated by black arrows). The pressure tank 512 is completely filled when the internal air pressure of the internal air bladder 522 equals the supply water pressure, and/or when the supply toggle valve disconnects the pressure tank 522 from the water supply. Additionally, the three-way flushing valve 514 closes the pressure tank 512 off from the flushing rim 526.

Figure 6:
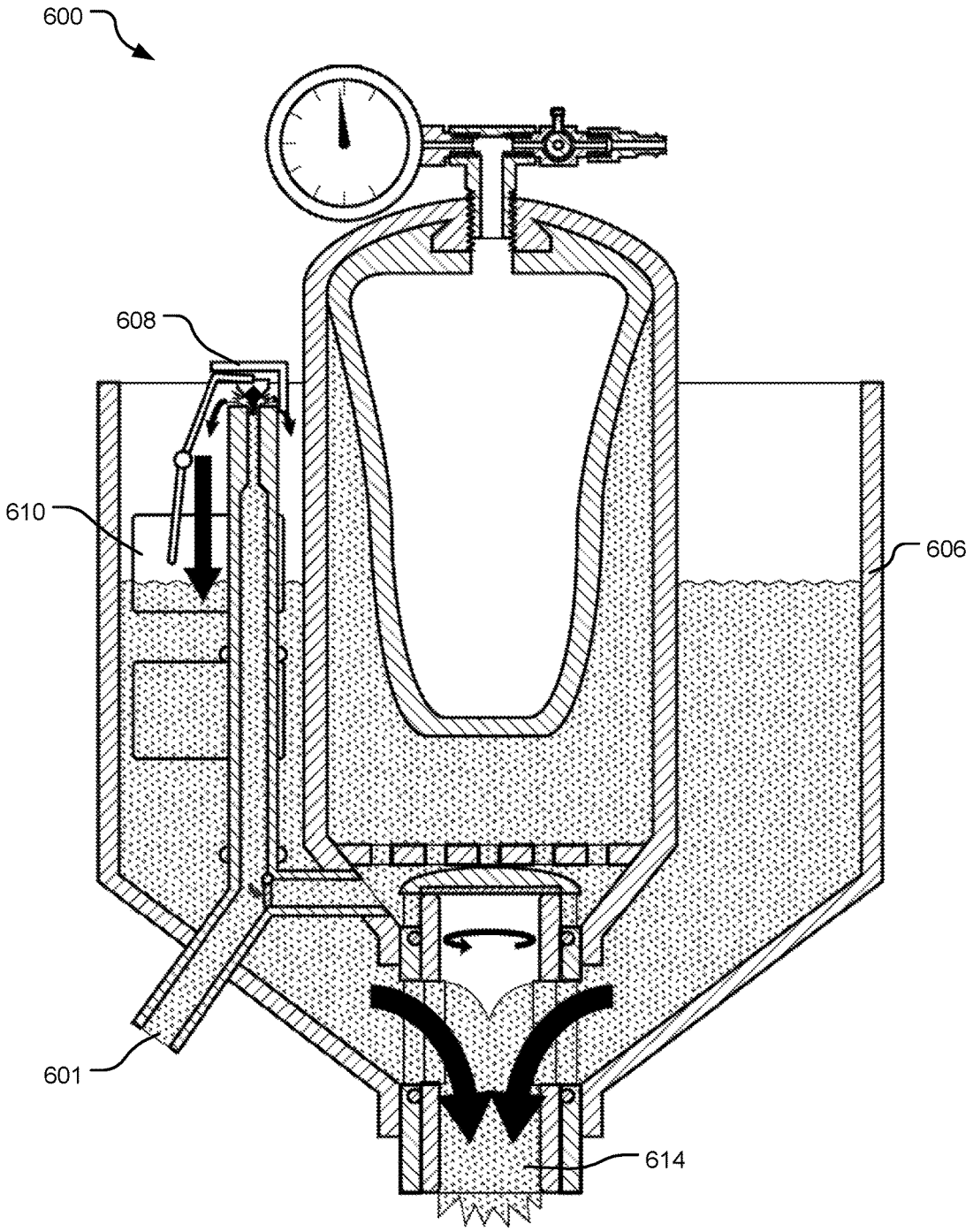
FIG. 6 illustrates a cross-sectional front view of an example low flush toilet tank system during a passive release stage.

FIG. 6 illustrates a cross-sectional front view of an example low flush toilet tank system 600 during a passive release stage. The passive release stage in FIG. 6 occurs simultaneously with the pressurization stage shown in FIGS. 4 and 5. In the passive release stage, the three-way flushing valve 614 is tripped by the tank lever (not shown) into a position allowing only the gravity tank 606 to drain into the flushing rim of the attached toilet (not shown). As the water level in the gravity tank 606 drops, the inlet float valve 610 will also drop, activating the fill valve 608 to allow the gravity tank 606 to be filled by water from the water supply 601.

Figure 7:
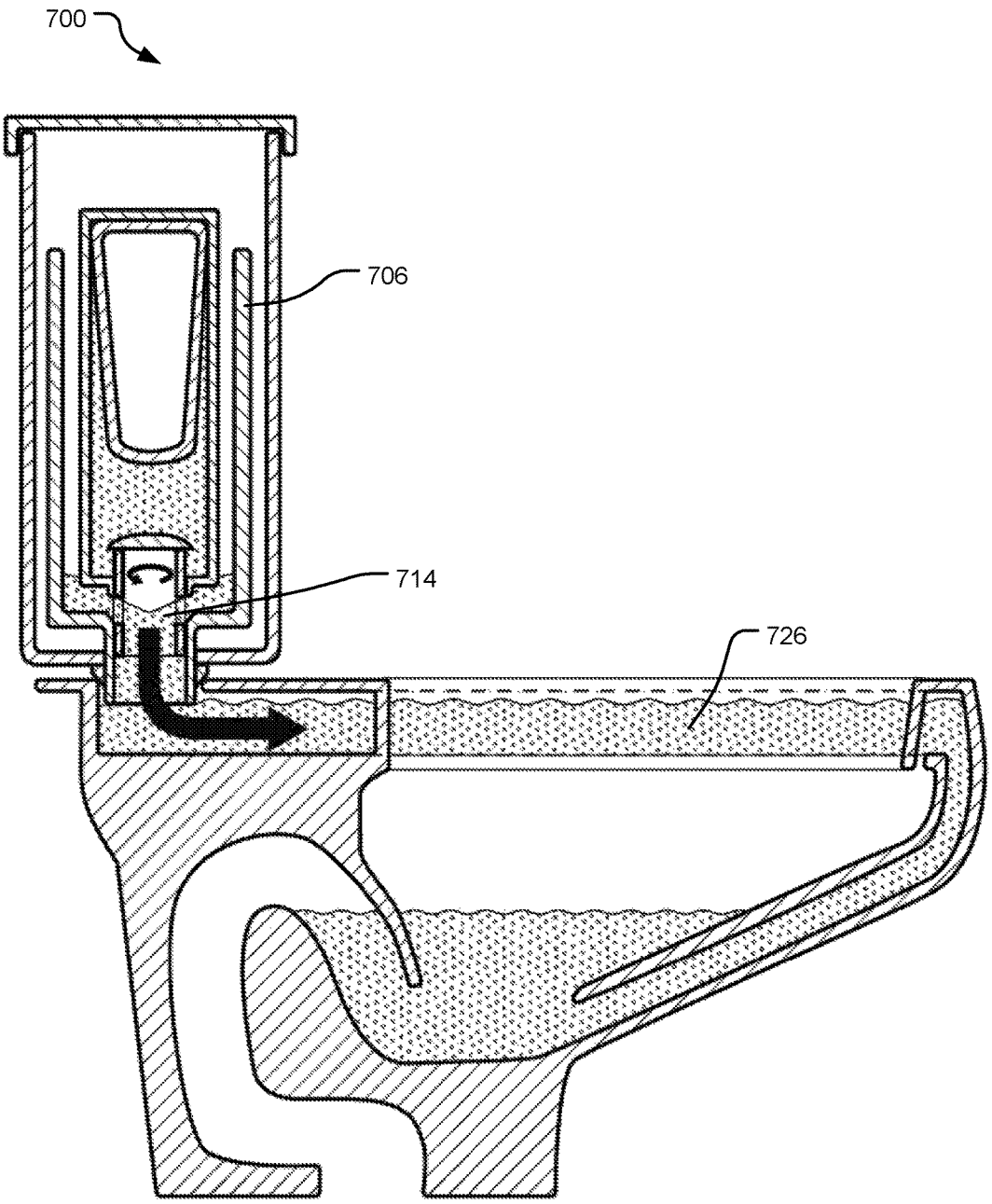
FIG. 7 illustrates a cross-sectional side view of an example low flush toilet system during a passive release stage.

FIG. 7 illustrates a cross-sectional side view of an example low flush toilet system 700 during a passive release stage. The passive release stage in FIG. 7 occurs simultaneously with the pressurization stage shown in FIGS. 4 and 5. In the passive release stage, the three-way flushing valve 714 is tripped by the tank lever (not shown) into a position allowing only the gravity tank 706 to drain into the flushing rim 526 of the attached toilet. As the water level in the gravity tank 706 drops, the inlet float valve 710 (not shown) will also drop, activating the fill valve (not shown) to allow the gravity tank 706 to be filled by water from the water supply.

Figure 8:
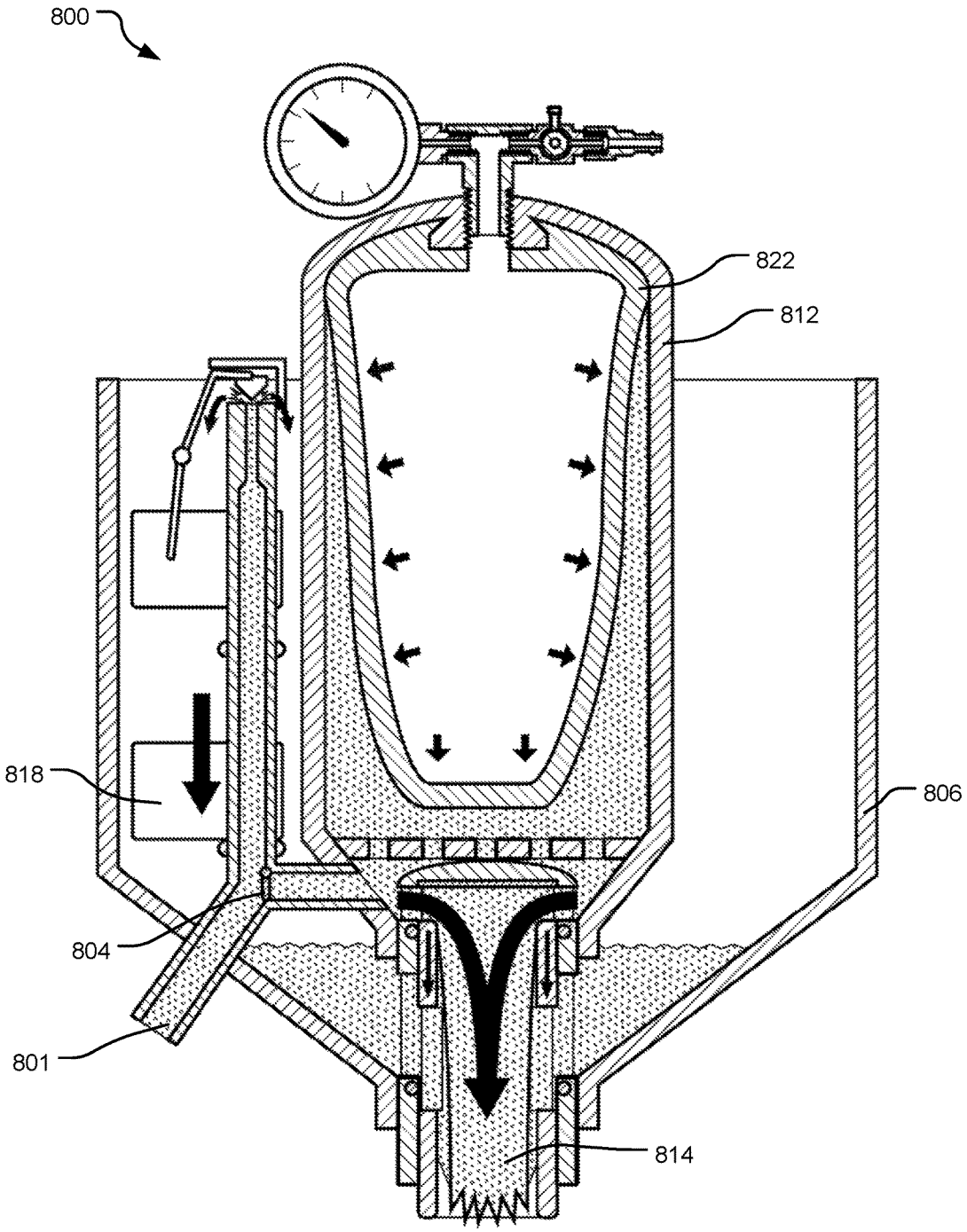
FIG. 8 illustrates a cross-sectional front view of an example low flush toilet tank system during a pressure release stage.

FIG. 8 illustrates a cross-sectional front view of an example low flush toilet tank system 800 during a pressure release stage. Once nearly all of the water in the gravity tank 806 has emptied into the flushing rim of the attached toilet (not shown), the pressure actuation float 818 trips both the supply toggle valve 804 and the three-way flushing valve 814. The supply toggle valve 804 is tripped into a position that seals off the pressure tank 812 from the water supply 801, allowing the gravity tank 806 to be filled by the water supply 801. The three-way flushing valve 814 is tripped to open the pressure tank 812 and seal the gravity tank 806. When the pressure tank 812 is opened, the internal air bladder 822 expands, pushing the water from the pressure tank 812 into the flushing rim (not shown) of the toilet (not shown) at a high flow rate. Because the flushing rim is loaded with water from the gravity tank 806, the high-pressure water coming from the pressure tank 812 creates a siphon to drain the toilet bowl (not shown) of waste.

Figure 9:
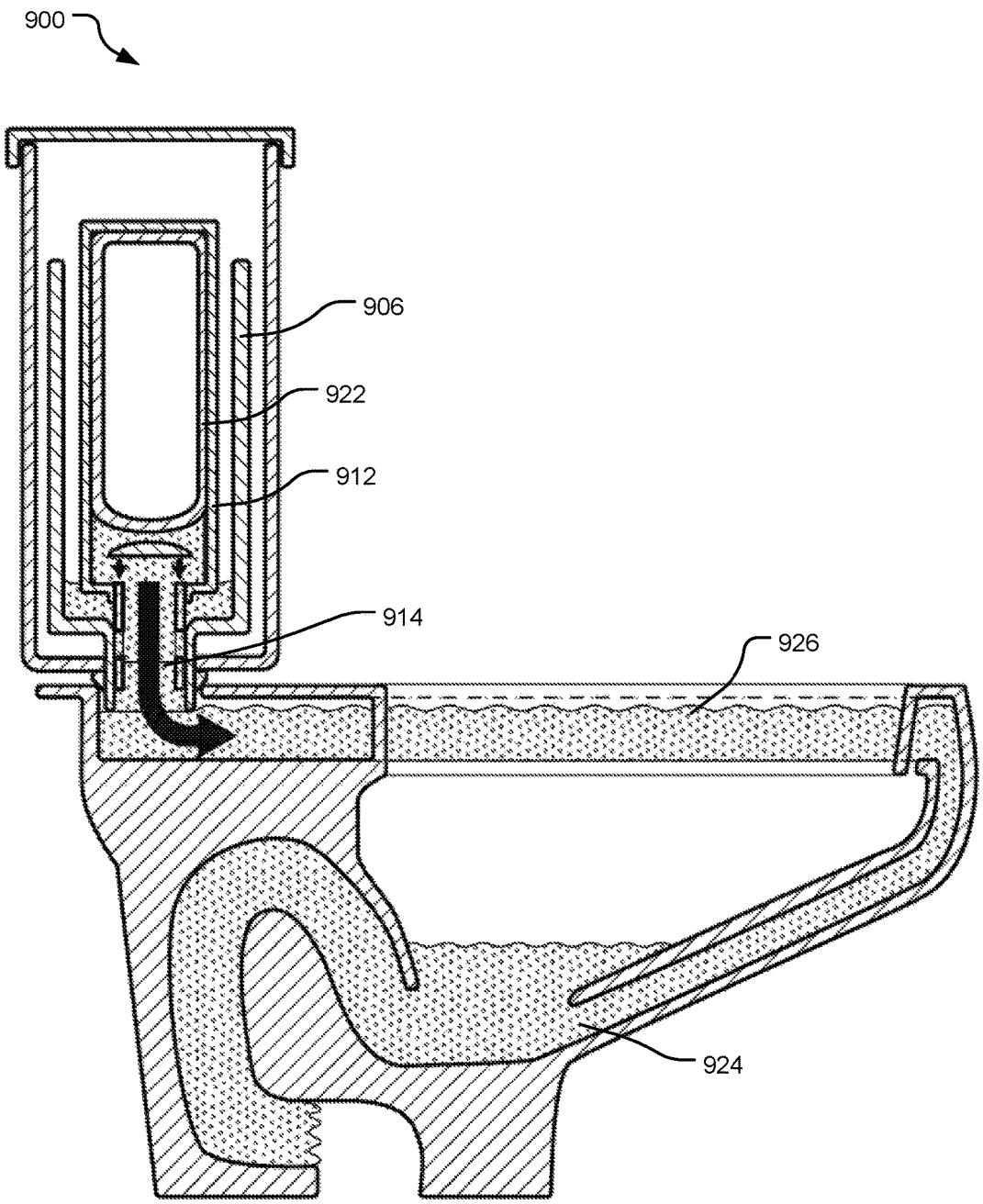
FIG. 9 illustrates a cross-sectional side view of an example low flush toilet system during a pressure release stage.

FIG. 9 illustrates a cross-sectional side view of an example low flush toilet system 900 during a pressure release stage. Once nearly all of the water in the gravity tank 906 has emptied into the flushing rim 926 of the attached toilet (924), the pressure actuation float (not shown) trips both the supply toggle valve (not shown) and the three-way flushing valve 914. The supply toggle valve is tripped into a position that seals off the pressure tank 912 from the water supply (not shown), allowing the gravity tank 906 to be filled by the water supply. The three-way flushing valve 914 is tripped to open the pressure tank 912 and seal the gravity tank 906. When the pressure tank 912 is opened, the internal air bladder 922 expands, pushing the water from the pressure tank 912 into the flushing rim (not shown) of the toilet (not shown) at a high flow rate. Because the flushing rim is loaded with water from the gravity tank 906, the high-pressure water coming from the pressure tank 912 creates a siphon to drain the toilet bowl (not shown) of waste.

Figure 10:
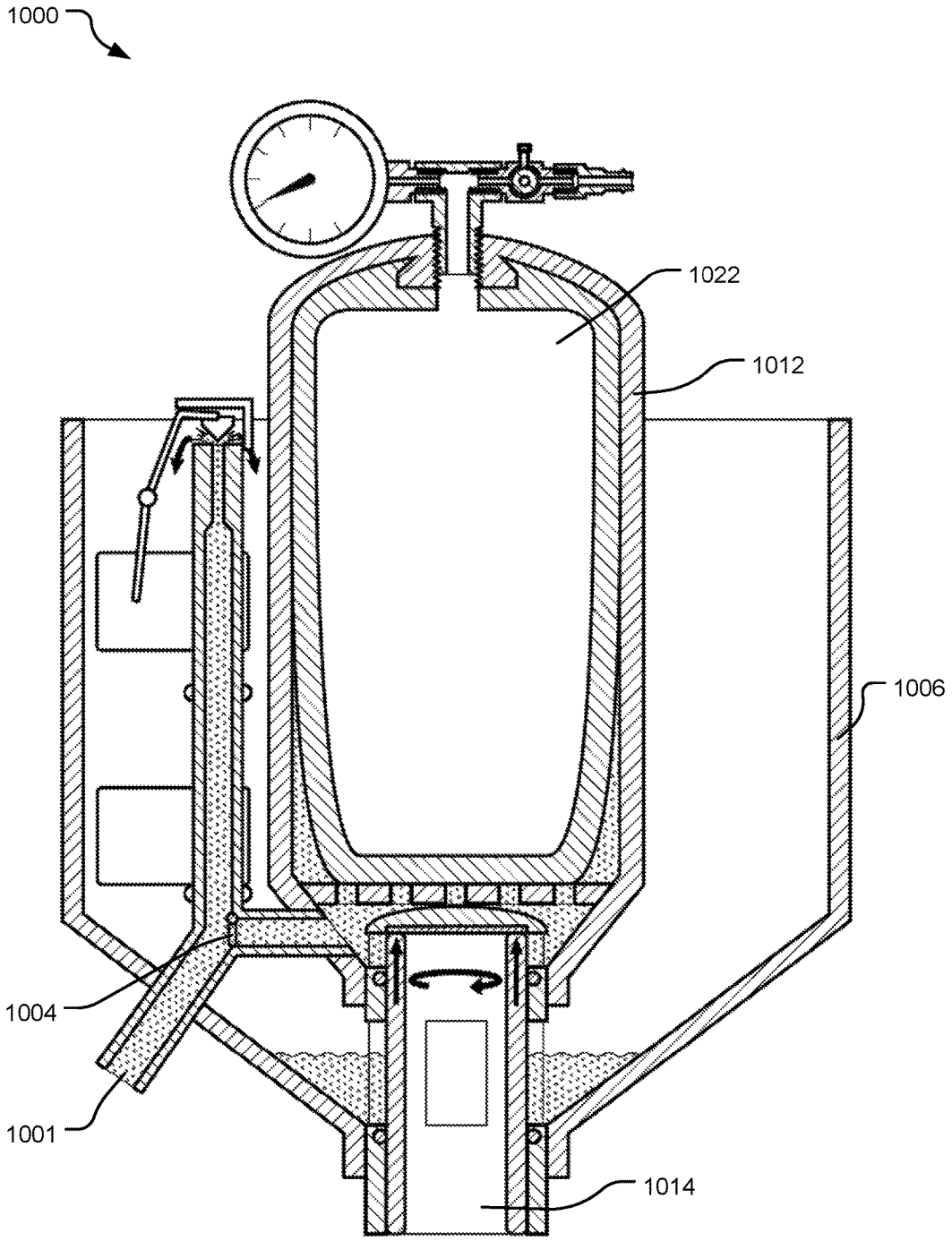
FIG. 10 illustrates a cross-sectional front view of an example low flush toilet tank system during a valve shutoff stage.

FIG. 10 illustrates a cross-sectional front view of an example low flush toilet tank system 1000 during a valve shutoff stage. During the valve shutoff stage, the flushing cycle completes by refilling the toilet bowl (not shown) with water draining from the flushing rim (not shown). Additionally, the three-way flushing valve 1014 is returned to its original closed stage, sealing both the pressure tank 1012 and the gravity tank 1006. The supply toggle valve 1004 is in a position that seals off the pressure tank 1012 from the water supply 1001 and allows the gravity tank 1006 to begin filling from the water supply 1001. The internal air bladder 1022 does not expand or contract during this stage because the pressure tank 1012 is sealed off from the water supply.

Figure 11:
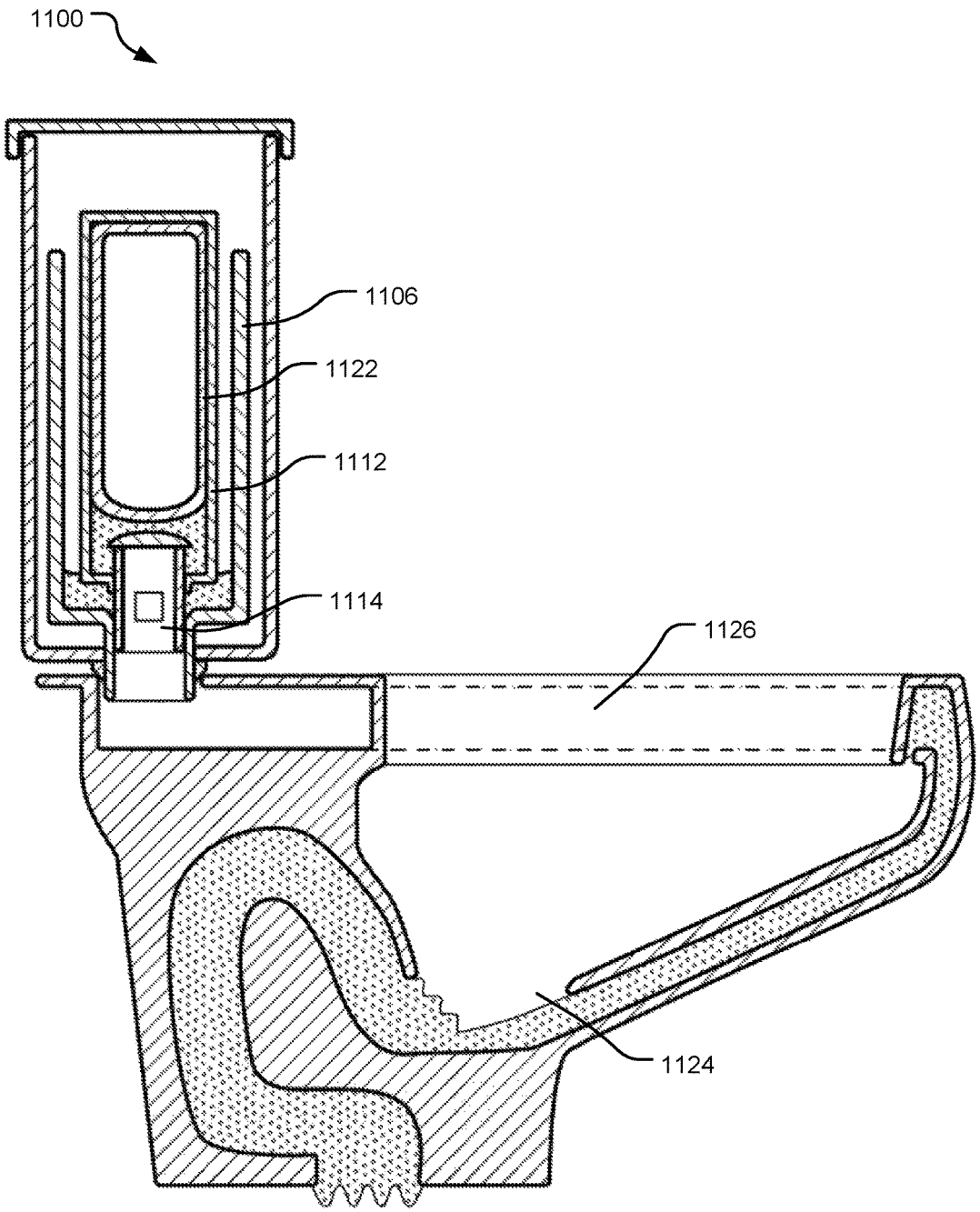
FIG. 11 illustrates a cross-sectional side view of an example low flush toilet system during a valve shutoff stage.

FIG. 11 illustrates a cross-sectional side view of an example low flush toilet system 1100 during a valve shutoff stage. During the valve shutoff stage, the flushing cycle completes by refilling the toilet bowl 1124 with water draining from the flushing rim 1126. Additionally, the three-way flushing valve 1114 is returned to its original closed stage, sealing both the pressure tank 1112 and the gravity tank 1106. The supply toggle valve (not shown) is in a position that seals off the pressure tank 1112 from the water supply (not shown) and allows the gravity tank 1106 to begin filling from the water supply. The internal air bladder 1122 does not expand or contract during this stage because the pressure tank 1112 is sealed off from the water supply.

Figure 12:
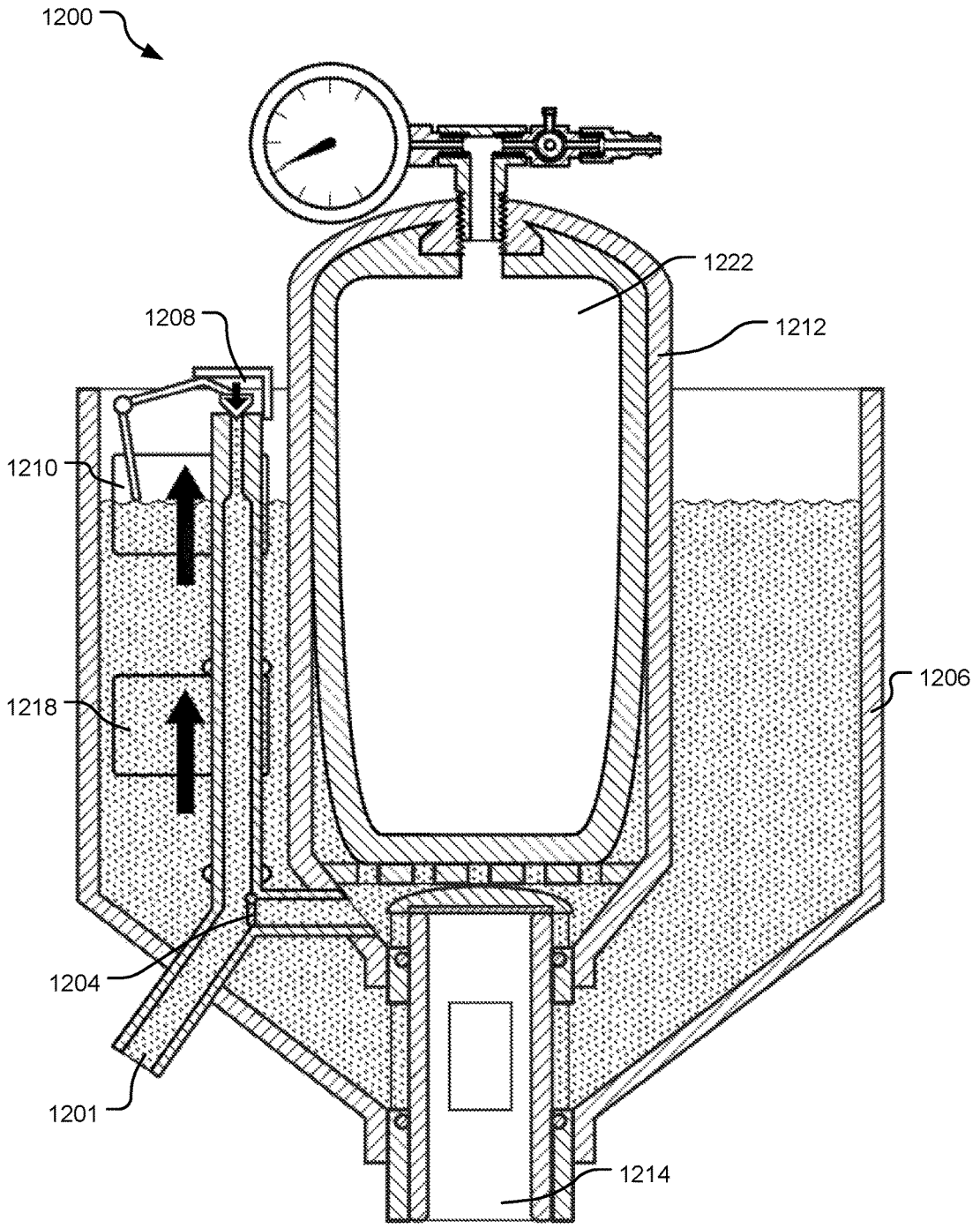
FIG. 12 illustrates a cross-sectional front view of an example low flush toilet tank system during a passive fill stage.

FIG. 12 illustrates a cross-sectional front view of an example low flush toilet tank system 1200 during a passive fill stage. During the passive fill stage, the gravity tank 1206 is filled. The three-way flushing valve 1214 remains in a position that seals off both the gravity tank 1206 and the pressure tank 1212 from the flushing rim (not shown). Additionally, the supply toggle valve 1204 remains in a position that allows water from the water supply 1201 to fill the gravity tank 1206. As the gravity tank 1206 is filled, the pressure actuation float 1218 returns to its original position. As the gravity tank 1206 reaches a full capacity, the inlet float valve 1210 moves up, triggering the fill valve 1208 to move to a closed position, sealing off the gravity tank 1206. Once the passive fill stage is complete, the low flush toilet's tank system is returned to its neutral, pre-flush state, with water in the toilet bowl (not shown), no water in the flushing rim, and the internal air bladder 1222 in a neutral state, as shown in FIG. 2.

Figure 13:
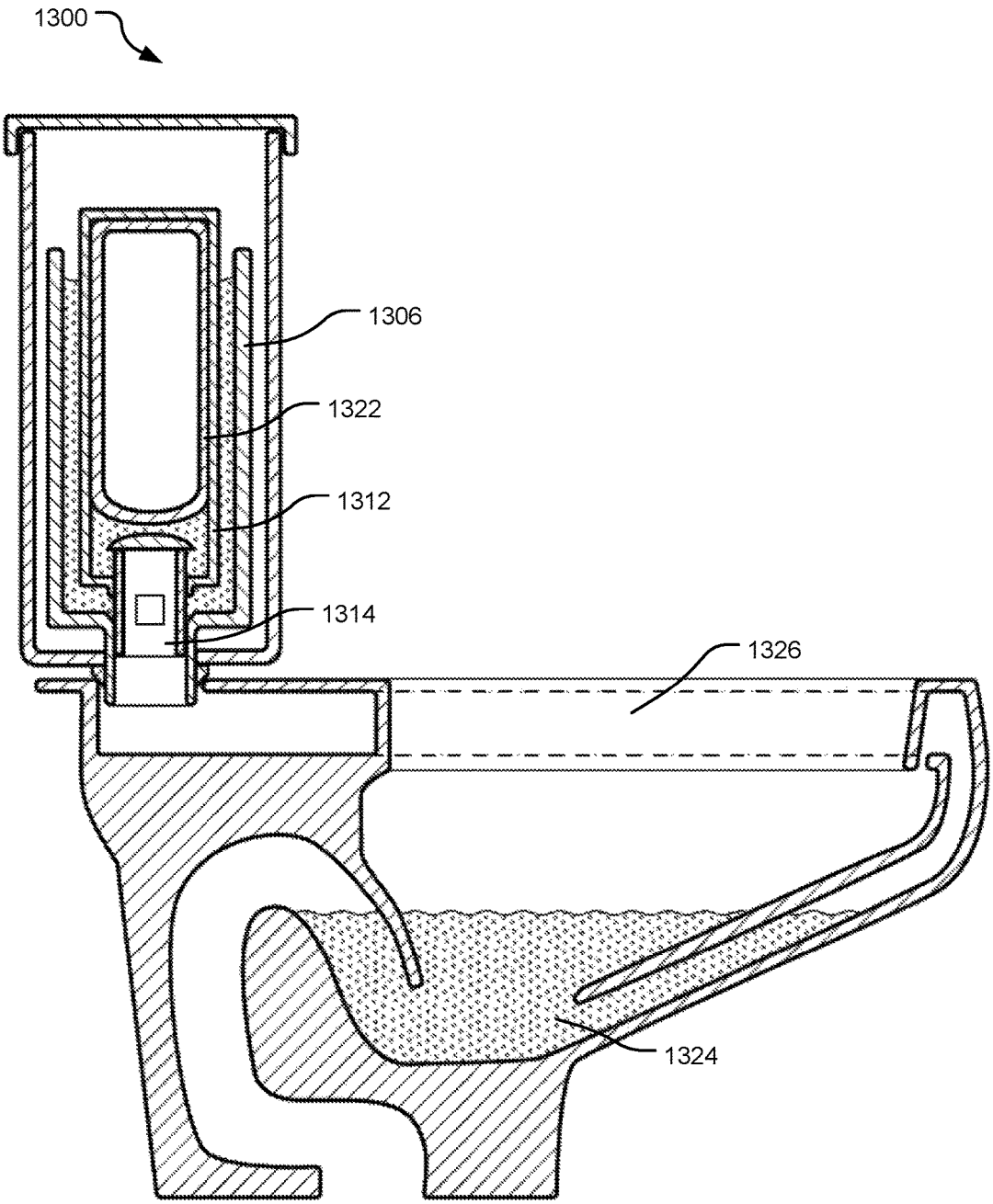
FIG. 13 illustrates a cross-sectional side view of an example low flush toilet system during a passive fill stage.

FIG. 13 illustrates a cross-sectional side view of an example low flush toilet system 1300 during a passive fill stage. During the passive fill stage, the gravity tank 1306 is filled. The three-way flushing valve 1314 remains in a position that seals off both the gravity tank 1306 and the pressure tank 1312 from the flushing rim 1326. Additionally, the supply toggle valve (not shown) remains in a position that allows water from the water supply (not shown) to fill the gravity tank 1306. As the gravity tank 1306 is filled, the pressure actuation float (not shown) returns to its original position. As the gravity tank 1306 reaches a full capacity, the inlet float valve (not shown) moves up, triggering the fill valve (not shown) to move to a closed position, sealing off the gravity tank 1306. Once the passive fill stage is complete, the low flush toilet's tank system is returned to its neutral, pre-flush state, with water in the toilet bowl 1324, no water in the flushing rim 1326, and the internal air bladder 1322 in a neutral state, as shown in FIG. 2.

FIGS. 14-21 illustrate example low flush toilet tank systems that include a magnetic valve release system. The magnetic valve release system is configured to control the opening and closing of both a gravity tank and a pressure tank, thereby selectively discharging the water and controlling the flow of water between the first tank and the toilet and between the second tank and the toilet.

Figure 14:
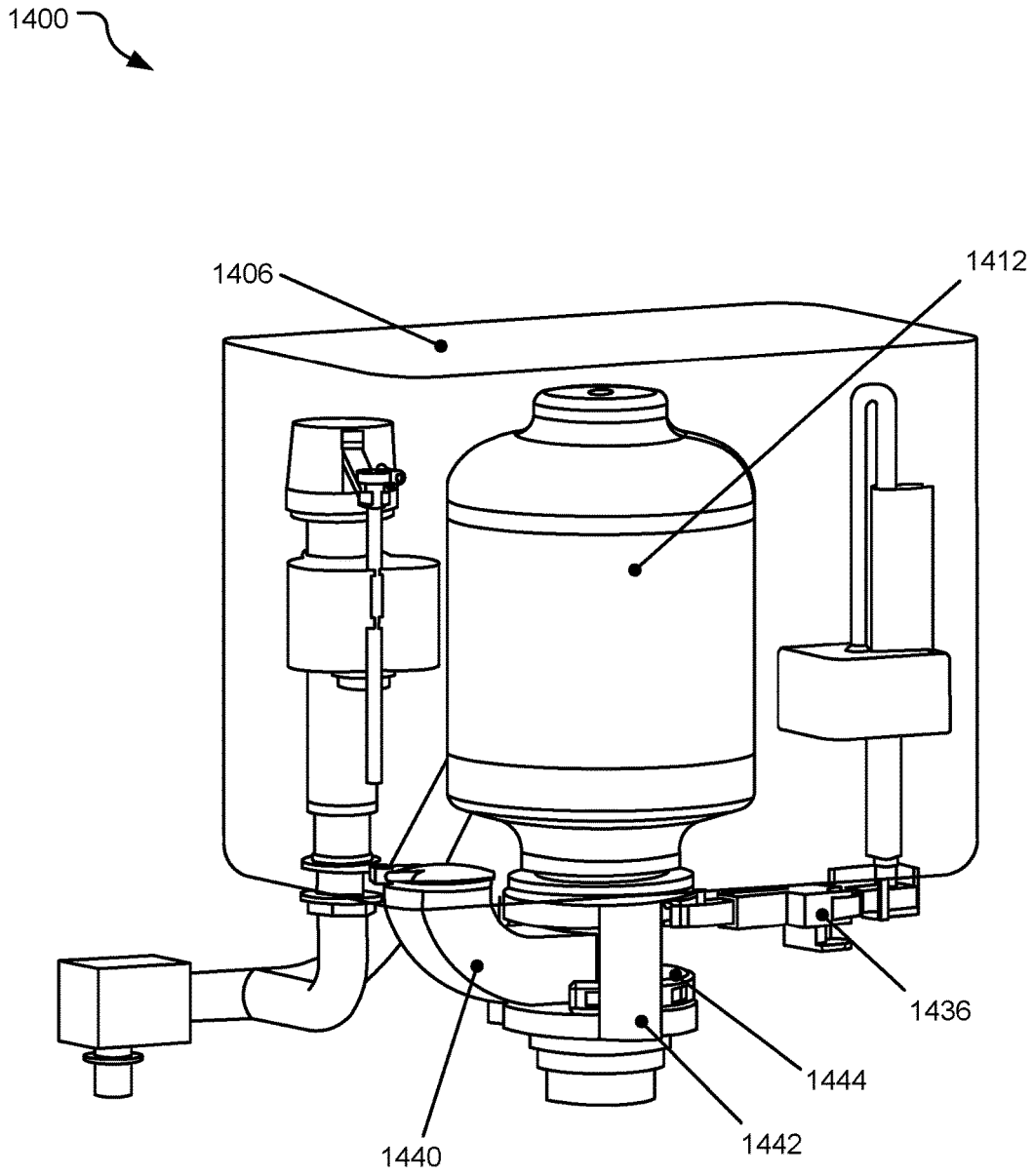
FIG. 14 illustrates a cross-sectional side view of a low flush toilet tank system during a resting state.

Referring to FIG. 14, the low flush toilet tank system 1400 includes a magnetic valve release system in a resting state. The magnetic valve release system includes a magnet chassis 1442, a concentric magnet c-ring 1444, and a sliding cylinder (e.g., sliding cylinder 1548 shown in FIG. 19). The magnet chassis 1442 and magnet c-ring 1444 include magnets placed in alternating positive and negative orientations.

As the magnet chassis 1442 is rotated horizontally (described in further detail below), the magnetic effect on the magnet c-ring 1444 between the magnets on both the magnet chassis 1442 and magnet c-ring 1444 changes, allowing the magnet c-ring 1444 to translate vertically on the sliding cylinder.

The magnet c-ring 1444 is connected to the sliding cylinder and is prevented from rotating horizontally along with the magnet chassis 1442. The sliding cylinder slides vertically and is configured to open paths for either the passive tank 1406 or the active tank 1412 to release water into the toilet (not shown).

Specifically, in some implementations, at least one aperture may be located on the sliding cylinder. When the sliding cylinder slides vertically, an aperture may be moved into alignment with another aperture or channel connected to the passive tank or the active tank. When the aperture is moved into alignment with another aperture or a channel, a path may be opened for either the gravity tank or the pressure tank to release water into the toilet.

In the implementations shown and described in FIGS. 14-21, the sliding cylinder slides vertically, an aperture (not shown) moves into alignment with a passive spill channel 1440 connected to the passive tank 1406. When the aperture is moved into alignment with the passive spill channel 1440, a path may be opened for the gravity tank 1406 to release water into the toilet. After the gravity tank 1406 is emptied, the magnet chassis 1442 returns to a neutral position sealing the gravity tank 1406 and the pressure tank 1412. The gravity tank 1406 and the pressure tank 1412 are then filled with water for the next flush.

Figure 15:
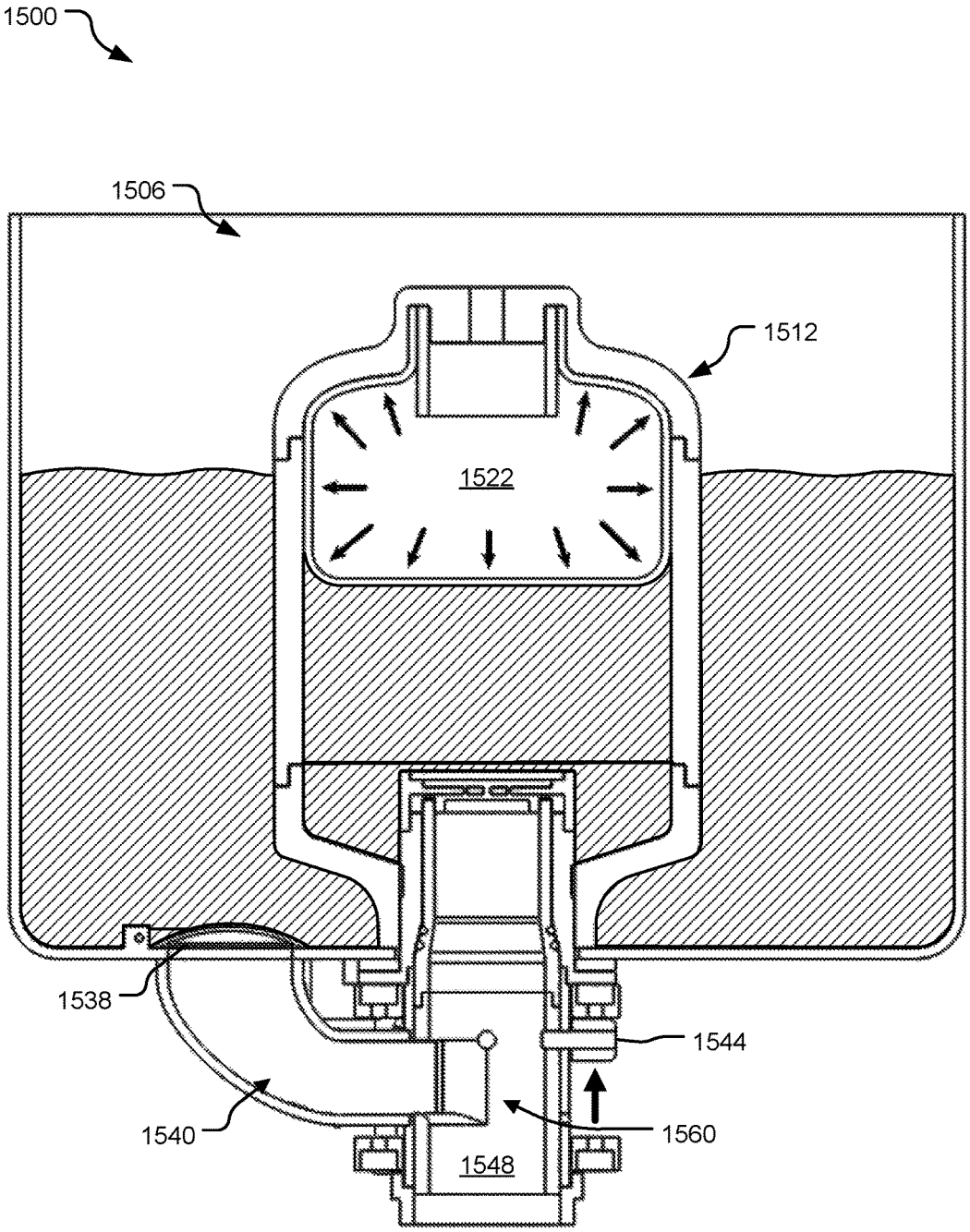
FIG. 15 illustrates a cross-sectional side view of an example low flush toilet system during a resting state.

FIG. 15 illustrates a cross-sectional side view of an example low flush toilet system 1500 during a resting state. The low flush toilet system 1500 is at a resting state when both the gravity tank 1506 and pressure tank 1512 are full and an internal air bladder 1522 inside the pressure tank 1512 is compressed. In some implementations, the internal air bladder 1522 is pre-pressurized at approximately 15-20 psi.

As shown in FIG. 15, the gravity tank 1506 is sealed by a flapper seal 1538. When the magnet c-ring 1544 is held in a first position adjacent (or an "up position") due to a magnetic attraction between the magnet c-ring 1544 and the magnet chassis (not shown), the pressure tank 1512 is sealed by a sliding cylinder 1548 that is attached to the magnet c-ring 1544.

The sliding cylinder can interact with a combination of o-rings and gaskets in the up position to create a seal on the pressure tank. In some implementations, a seal for the pressure tank may be created with different components. The pressure of the water acts perpendicular to the force of the seal. When the pressure tank is sealed, the gravity tank 1906 is simultaneously sealed off allowing the flapper seal 1938 to shut.

An aperture 1560 moves into alignment with a passive spill channel 1540 connected to the passive tank 1506. When the aperture 1560 is moved into alignment with the passive spill channel 1540, a path may be opened for the gravity tank 1406 to release water into the toilet.

Figure 16:
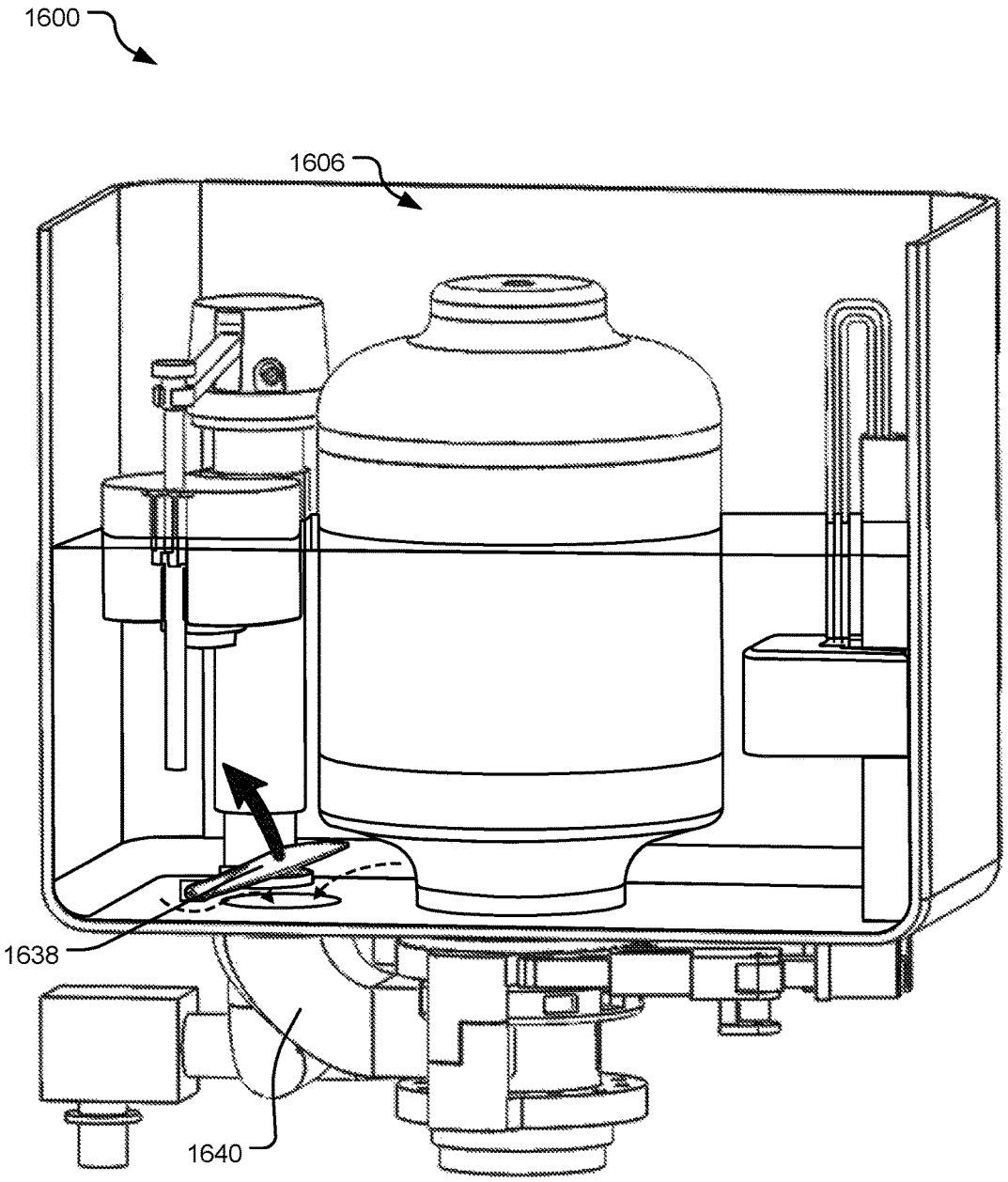
FIG. 16 illustrates a cross-sectional front view of an example low flush toilet tank system during a gravity flush stage.

FIG. 16 illustrates a cross-sectional front view of an example low flush toilet tank system 1600 during a gravity flush state. As shown in FIG. 16, the flapper seal 1638 may be opened. In some implementations, the flapper seal 1638 is manually opened by a user. For example, a user may activate the opening of the flapper seal 1638 by moving a lever or pushing a button (not shown) to activate a flush. The opening of the flapper seal 1638 initiates the outlet flow of water from the gravity tank 1606 to the toilet rim (not shown) via the passive tank channel 1640 through an aperture (not shown) and through a sliding cylinder (not shown).

Figure 17:
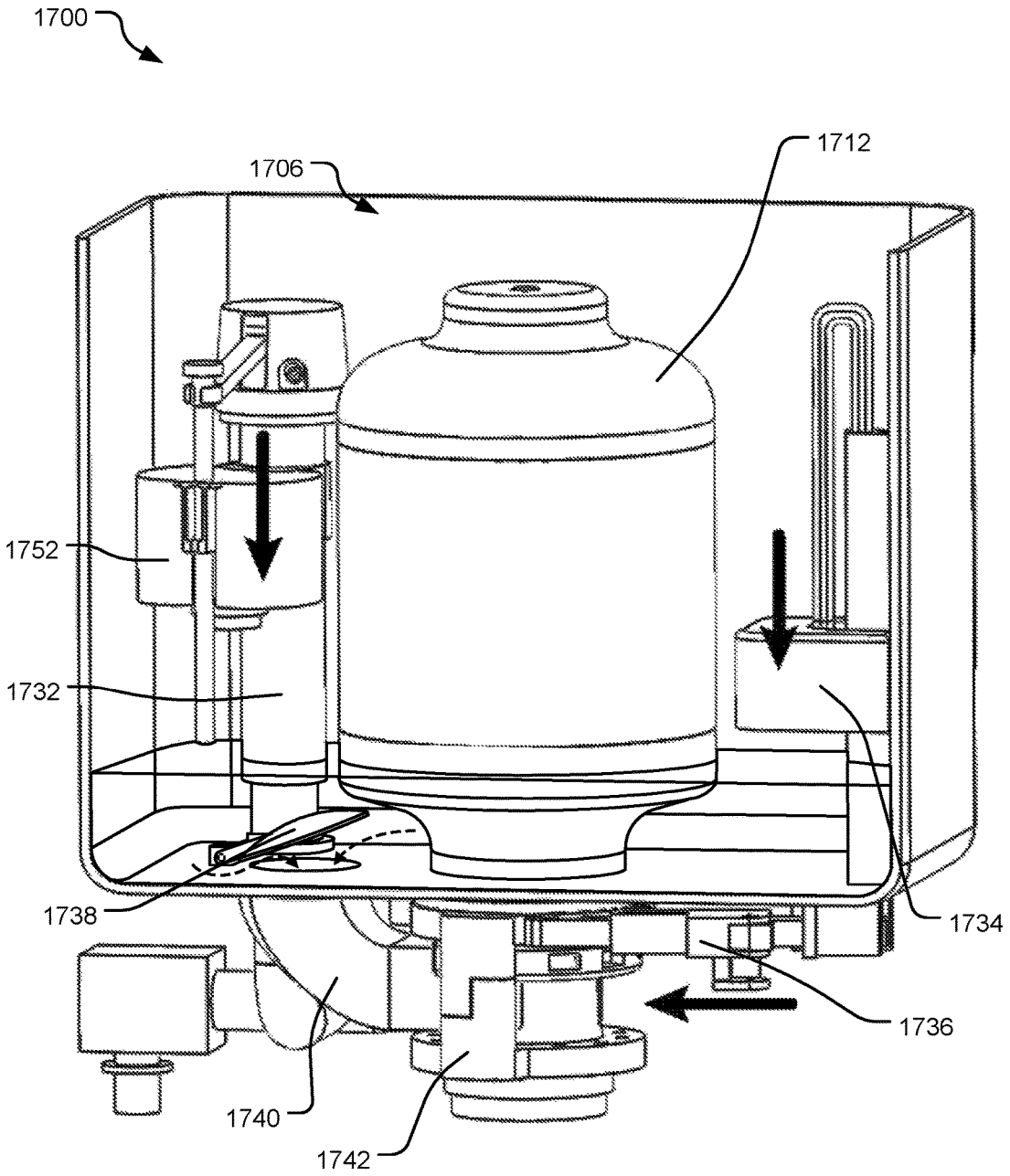
FIG. 17 illustrates a cross-sectional side view of an example low flush toilet system during a pressure actuation stage.

FIG. 17 illustrates a cross-sectional side view of an example low flush toilet system 1700 during a pressure actuation stage. As water flows from the gravity tank 1706 to the toilet (not shown) through an opened flapper seal 1738 via the passive tank channel 1740, the water level in the gravity tank 1706 drops. As the water level in the gravity tank 1706 drops, both an inlet float valve 1752 of the inlet float valve stack 1732 and a pressure actuation float 1734 drops, as shown in FIG. 17. When the inlet float 1752 drops the refilling of the gravity tank 1706 is initiated. The gravity tank 1706 is refilled at a rate lesser than the water is exiting out flapper seal 1738 until the flapper seal 1738 is closed, in which cased the gravity tank 1706 refills until the first float 1752 rises to shutoff the flow of water. When the water in the gravity tank 1706 is nearly empty the pressure actuation float 1734 drops to activate the release of the water in the pressurized tank.

The pressure actuation float 1734 is connected to a pressure actuation trigger assembly 1736. When the pressure actuation float 1734 drops vertically in the gravity tank 1706, the pressure actuation trigger assembly 1736 moves horizontally, and activates a magnet chassis 1742. The horizontal movement of the pressure actuation trigger assembly 1736 is described in FIG. 18.

Figure 18:
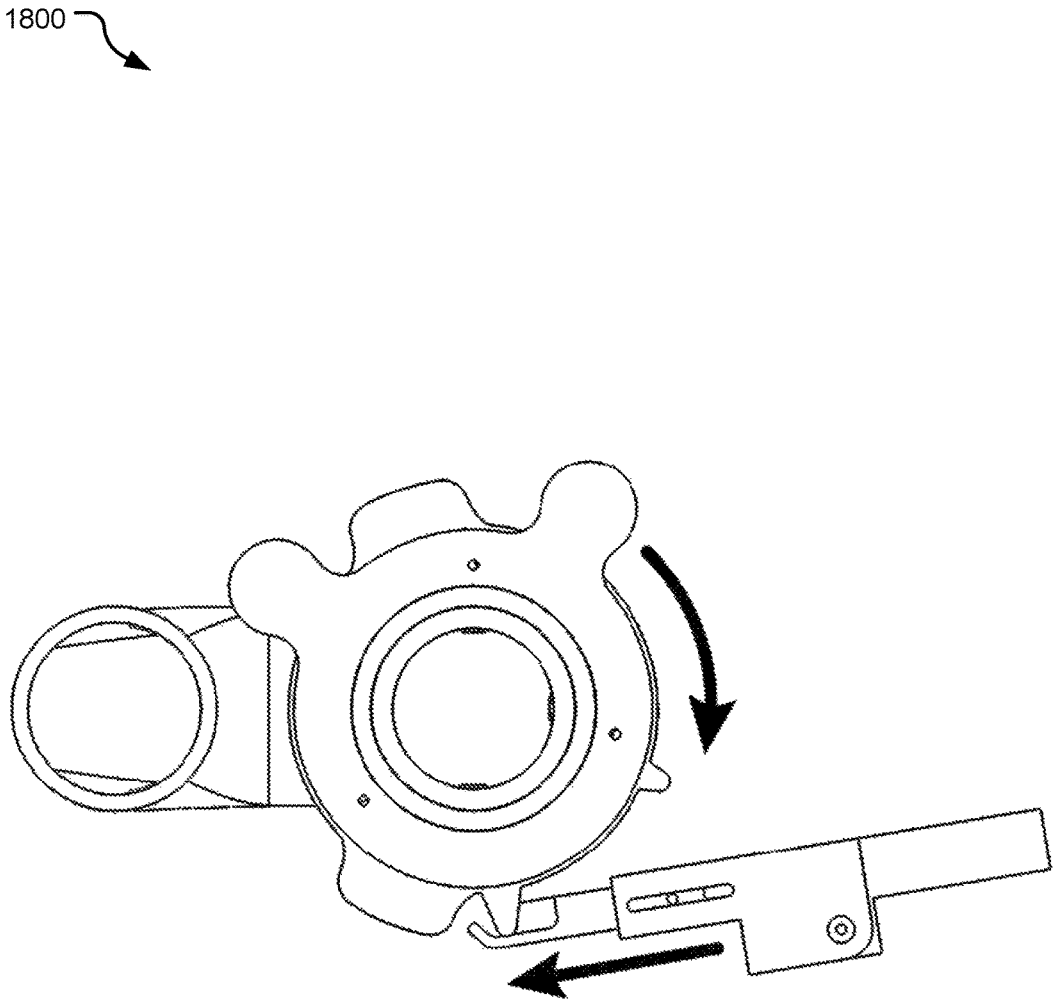
FIG. 18 illustrates a cross-sectional front view of an example low flush toilet tank system during a pressure actuation stage.

FIG. 18 illustrates a top view of an example pressure actuation trigger assembly 1800 during a pressure actuation stage. In some implementations, the pressure actuation trigger assembly 1800 is located exterior, below and adjacent to the passive tank (not shown) in a low flush toilet system. Other locations of the pressure actuation trigger assembly 1800 in a low flush toilet system are contemplated.

In the implementations described in FIGS. 14-21, the pressure actuation trigger assembly 1800 can move laterally. When a gravity tank drains water into a toilet and the water level drops, the active tank actuation float moves down in the passive tank toward the pressure actuation trigger assembly 1800, moving the pressure actuation trigger assembly 1800 horizontally.

When the pressure actuation trigger assembly 1800 moves laterally in directions as depicted by the arrows, a spring (not shown) inside the pressure actuation trigger assembly 1800 is compressed, and the pressure actuation trigger assembly 1800 pushes against a magnet chassis housing magnets. The magnet chassis rotates and controls a magnet c-ring that slides up and down a sliding cylinder in a vertical direction via the interaction between the magnets in the magnet chassis and the magnet c-ring. This mechanism controls the openings between the gravity tank and the toilet and between the pressure tank and the toilet.

Figure 19:
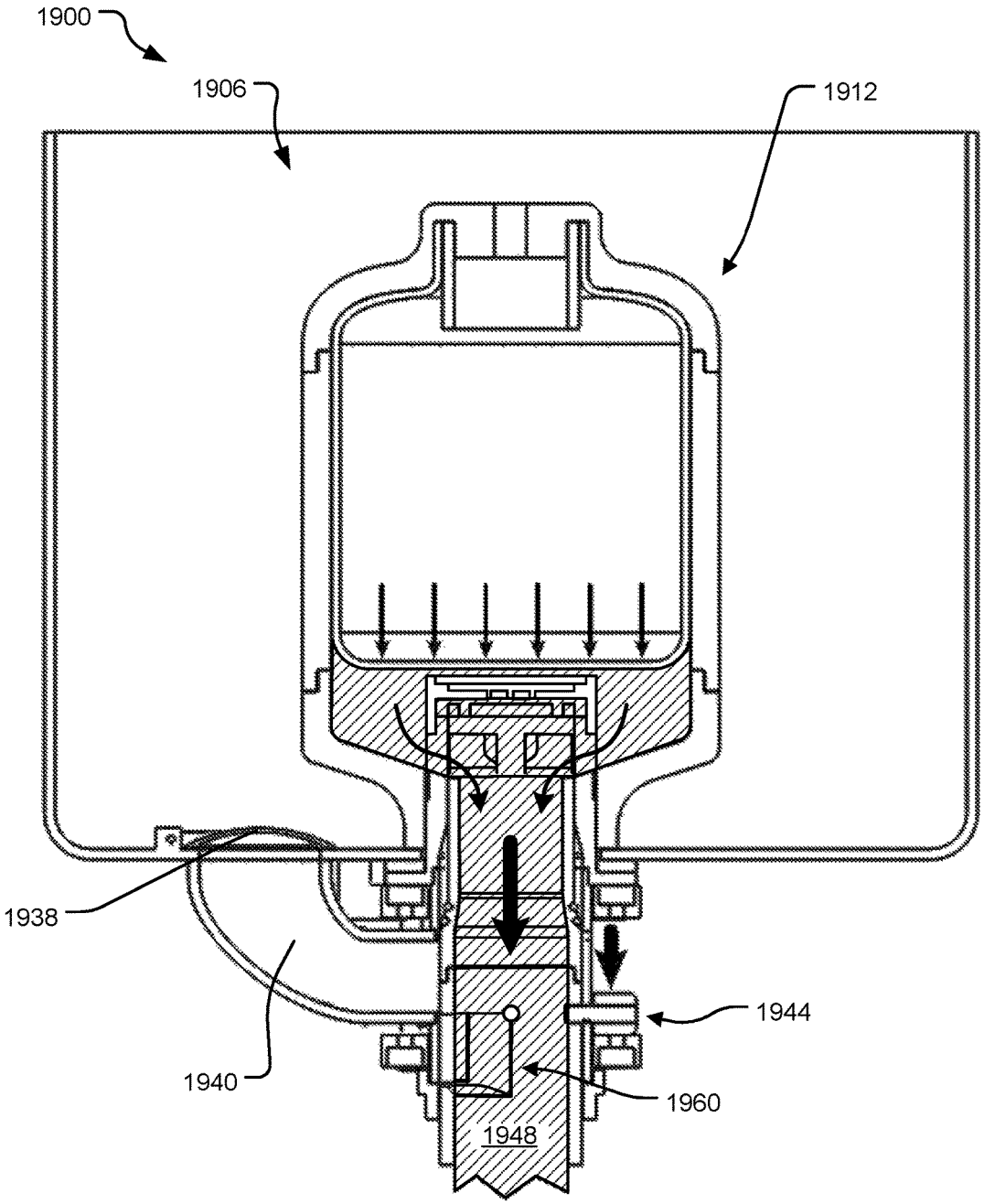
FIG. 19 illustrates a cross-sectional side view of an example low flush toilet system during a pressure flush stage.

FIG. 19 illustrates a cross-sectional side view of an example low flush toilet system 1900 during a pressure flush stage. At a certain point the force of the spring inside the pressure actuation trigger assembly (not shown) overcomes the sheer force of the magnets. When this occurs, the magnet chassis 1942 rotates exposing itself and exposing the magnet c-ring 1944 to an opposing magnetic field. The opposing magnetic field forces the magnet c-ring 1944 vertically downward along with the sliding cylinder 1948, in a second position adjacent (or a "down position"), removing a seal created with the sliding cylinder in an up position interacting with the o-rings and gaskets. Removal of the seal initiates the outlet flow of water from the pressure tank.

Figure 20:
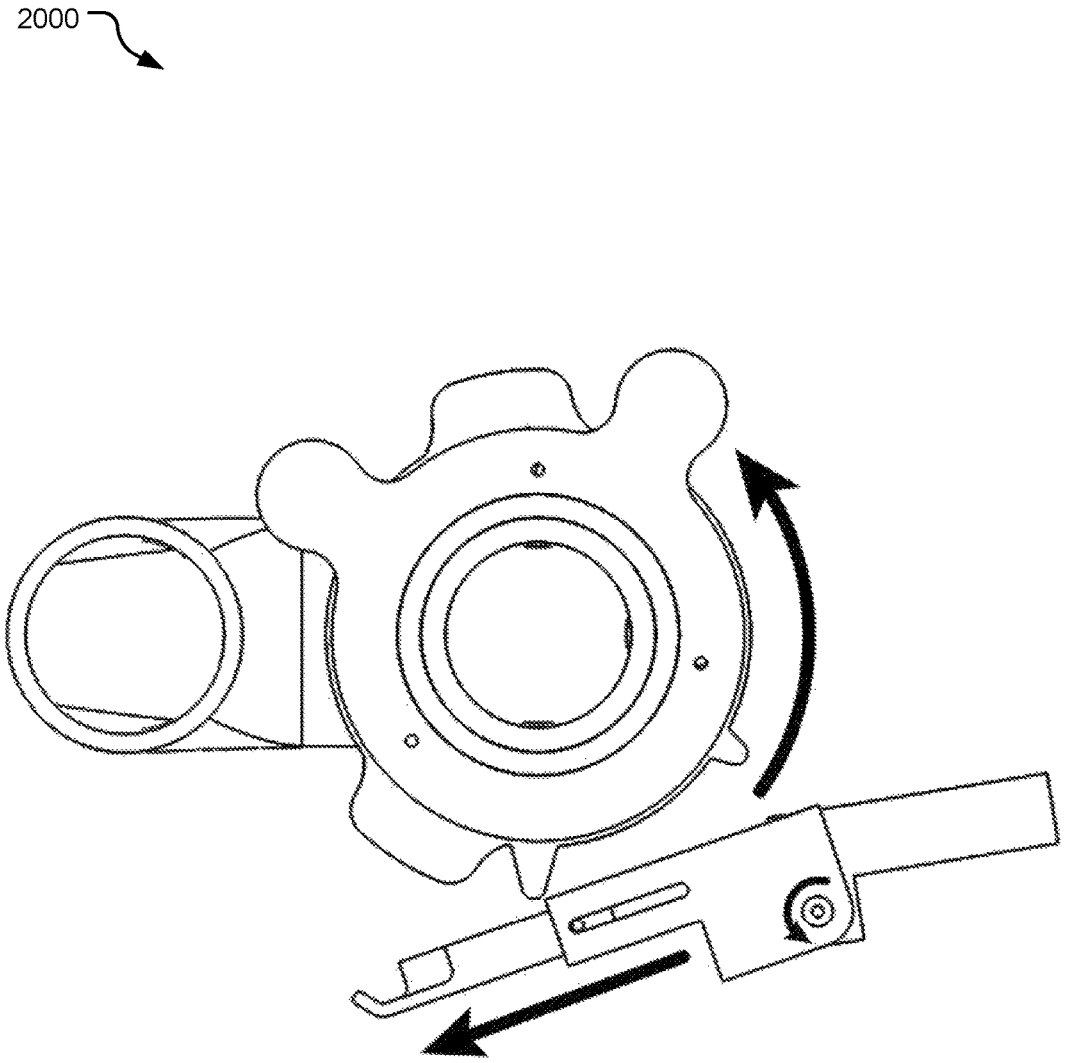
FIG. 20 illustrates a cross-sectional front view of an example low flush toilet tank system during a pressure flush stage.

FIG. 20 illustrates a top view of an example pressure actuation trigger assembly 2000 during a pressure flush stage. In some implementations, the pressure actuation trigger assembly 2000 is located exterior, below and adjacent to the passive tank (not shown) in a low flush toilet system. The pressure actuation trigger assembly 2000 can move laterally in directions as depicted by the arrows. A spring (not shown) is located inside the pressure actuation trigger assembly.

Once the magnet chassis (not shown) has been rotated fully the pressure actuation trigger assembly 2000 rotates slightly, slipping off of the magnet chassis, and allowing a weak spring to return the magnet chassis to a neutral position.

Figure 21:
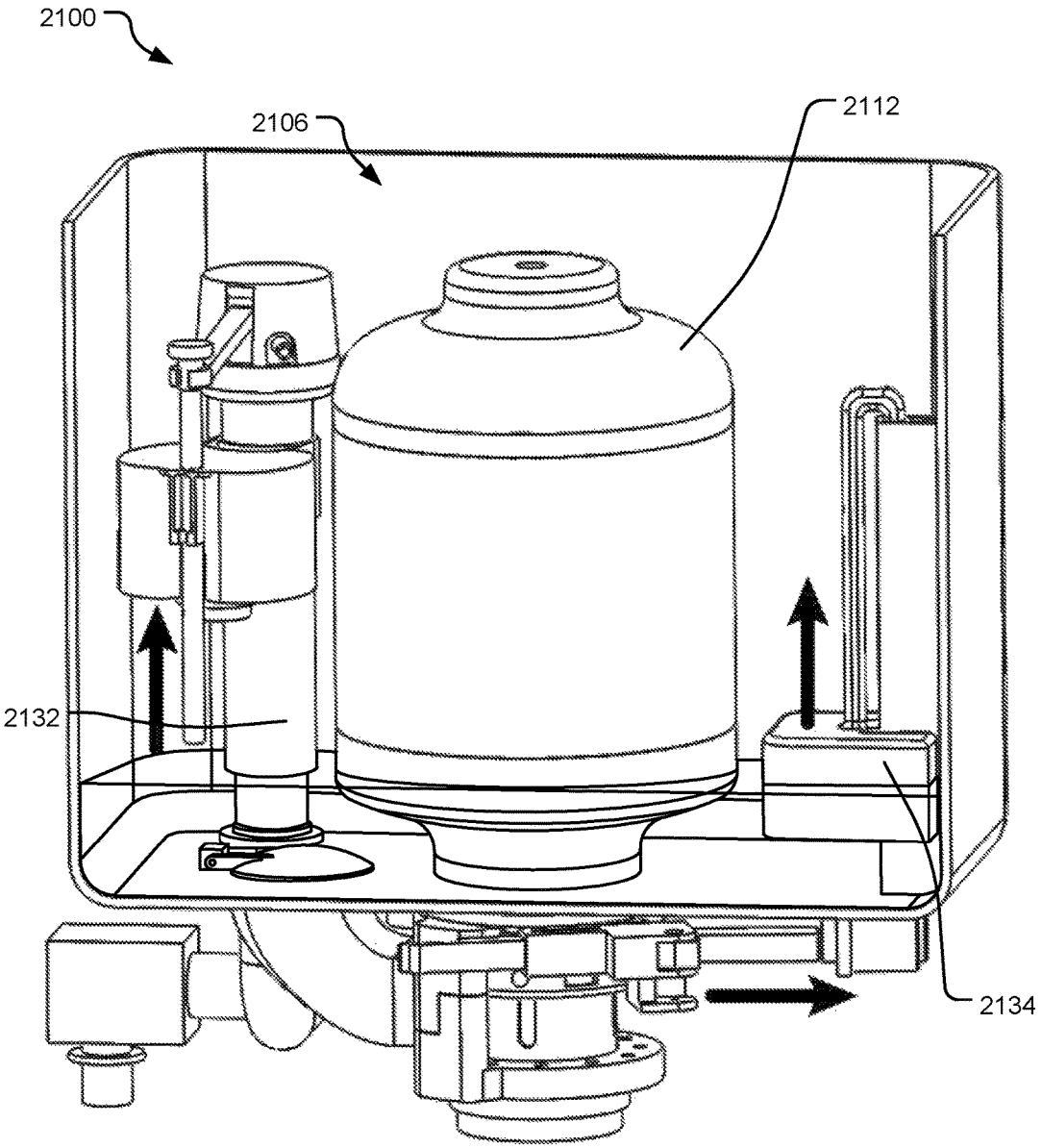
FIG. 21 illustrates a cross-sectional side view of an example low flush toilet system during a refill stage.

FIG. 21 illustrates a cross-sectional side view of an example low flush toilet system 2100 during a refill stage. Back in a neutral position, both the pressure tank 2112 and the gravity tank 2106 are sealed due to the magnets. The water level begins to the rise in the gravity tank 2106 returning the actuation float 2134 to a neutral state and shutting off the inlet float valve stack 2132. The water also flows into the pressure pressurizing the internal air bladder 2122 until the pressures equalize, which is controlled by the pressure regulator 2146.

Figure 22:
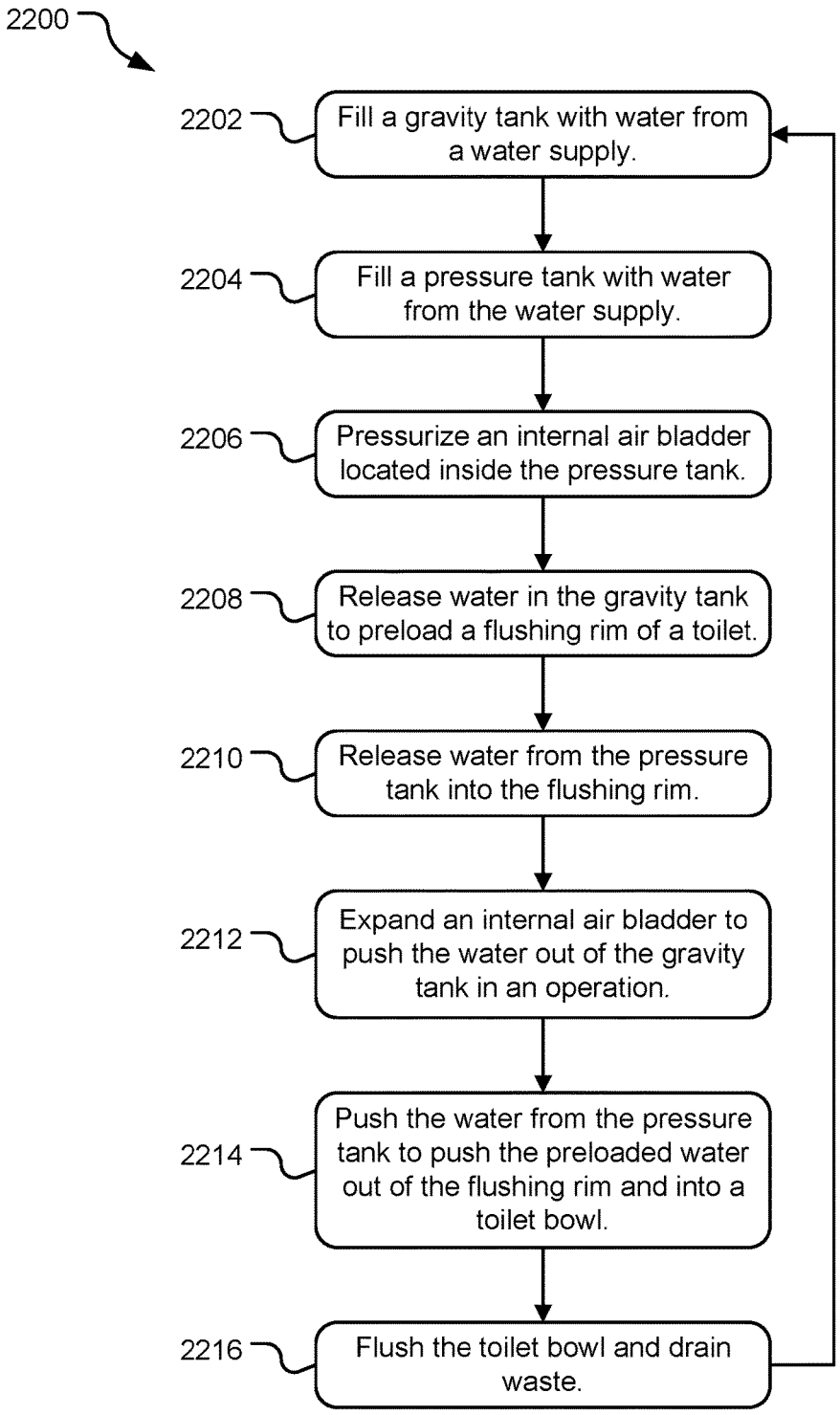
FIG. 22 illustrates example operations for a low flush toilet system.

FIG. 22 illustrates example operations 2200 for a low flush toilet system. An operation 2202 fills a gravity tank in the low flush toilet system with water from a water supply. An operation 2204 fills a pressure tank in the low flush toilet system with water from the water supply. In some implementations, the pressure tank may be located inside the gravity tank. In other implementations, the pressure tank may be located outside the gravity tank.

During and/or after the operation 2204 fills the pressure tank in the low flush toilet system with water, an operation 2206 pressurizes an internal air bladder located inside the pressure tank. The internal air bladder is compressed until its pressure matches the pressure of the water flowing into the pressure tank. When both the gravity tank and the pressure tank are full and the internal air bladder is compressed, the low flush toilet system is at a resting state.

During a releasing operation 2208, water in the gravity tank is released from the gravity tank to preload a flushing rim of a toilet. In some implementations, in order to release the water from only the gravity tank, a valve (e.g., a three-way flushing valve) is tripped into a position that seals off the pressure tank while allowing the gravity tank to release water into the flushing rim.

An operation 2210 releases water from the pressure tank into the flushing rim. During and/or after the water releases from the pressure tank, the internal air bladder expands and pushes the water out of the gravity tank in an operation 2212.

An operation 2214 pushes the water from the pressure tank to push the preloaded water out of the flushing rim and into a toilet bowl. The water blasting at a high flow rate from the pressure tank creates a siphon in the toilet bowl. The siphon created by the blast flushes the toilet bowl and drains waste in an operation 2216.

After waste is removed from the toilet bowl in operation 2216, operations 2202 and 2204 reset the toilet back to a neutral state and set up to begin the pressurization operation 2206 when the toilet needs to be flushed again.

Figure 23:
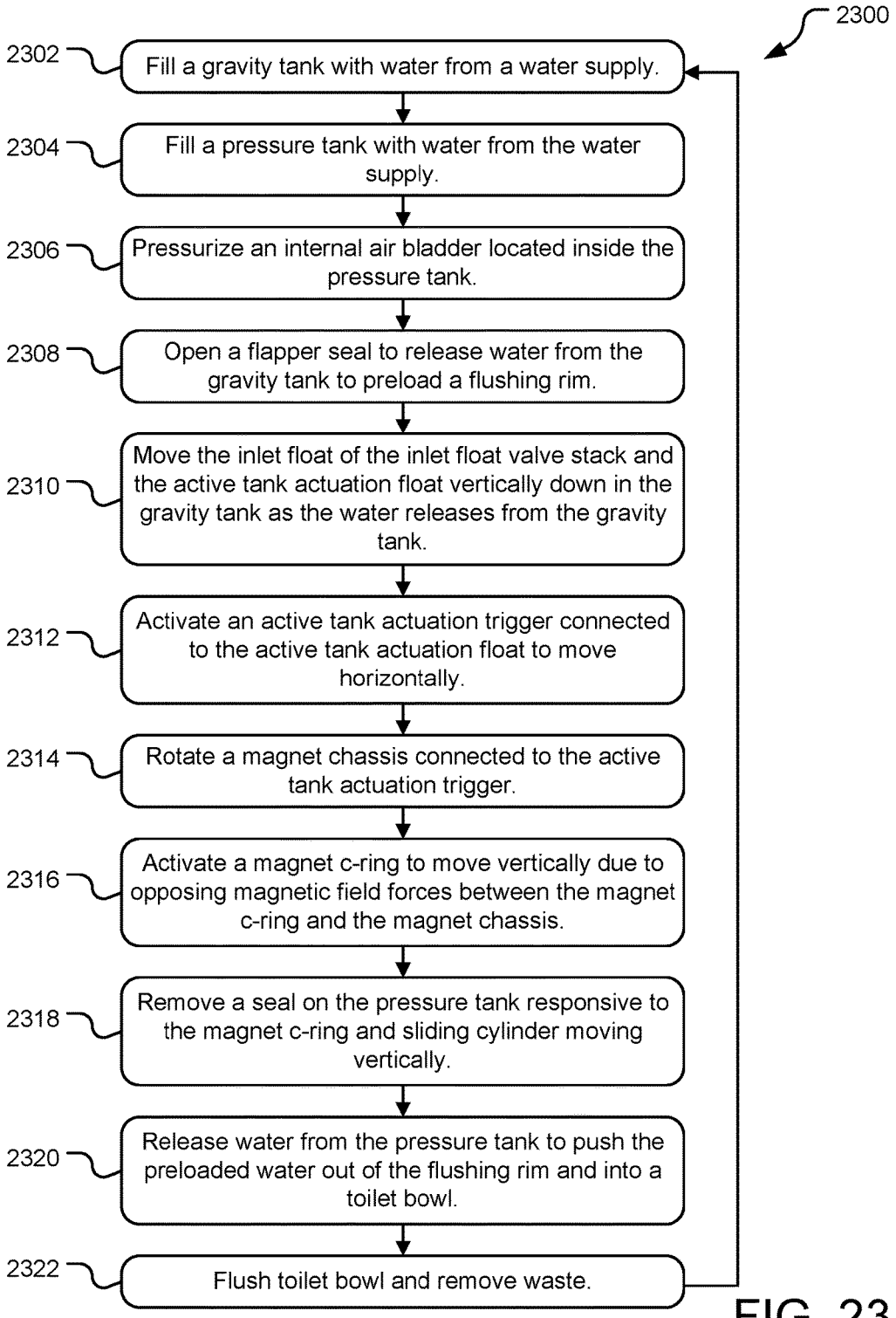
FIG. 23 illustrates example operations for a low flush toilet system.

FIG. 23 illustrates example operations 2300 for a low flush toilet system. An operation 2302 fills a gravity tank in the low flush toilet system with water from a water supply. An operation 2304 fills a pressure tank in the low flush toilet system with water from the water supply. In some implementations, the pressure tank may be located inside the gravity tank. In other implementations, the pressure tank may be located outside the gravity tank.

During and/or after the operation 2304 fills the pressure tank in the low flush toilet system with water, an operation 2306 pressurizes an internal air bladder located inside the pressure tank. The internal air bladder is compressed until its pressure matches the pressure of the water flowing into the pressure tank. When both the gravity tank and the pressure tank are full and the internal air bladder is compressed, the low flush toilet system is at a resting state.

During an operation 2308, a flapper seal is opened initiating the outlet flow of water from the passive tank to preload a flushing rim of a toilet. In some implementations, the flapper seal is opened manually by a user.

An operation 2310 moves the inlet float of the inlet float valve stack and the active tank actuation float vertically down in the gravity tank as the water releases from the gravity tank. The dropping of the inlet float will begin the refill of the gravity tank. An operation 2312 activates an active tank actuation trigger connected to the active tank actuation float to move horizontally. An operation 2314 rotates a magnet chassis connected to the active tank actuation trigger.

An operation 2316 activates a magnet c-ring to move vertically due to opposing magnetic field forces between the magnet c-ring and the magnet chassis. The magnet c-ring is connected to a sliding cylinder that seals the pressure tank. An operation 2318 removes a seal on the pressure tank responsive to the magnet c-ring and sliding cylinder moving vertically. An operation 2320 releases water from the pressure tank to push the preloaded water out of the flushing rim and into a toilet bowl. The water blasting at a high flow rate from the pressure tank creates a siphon in the toilet bowl. The siphon created by the blast drains waste from the toilet bowl in an operation 2322. After waste is removed from the toilet bowl in operation 2322, operations 2302 and 2304 reset the toilet system back to a neutral state.

The logical operations making up the implementations described herein are referred to variously as operations, steps, objects, or modules. Furthermore, it should be understood that logical operations may be performed in any order, adding or omitting operations as desired, unless explicitly claimed otherwise or a specific order is inherently necessitated by the claim language.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A toilet comprising:

a flushing rim;

a gravity tank to discharge gravity water by force of gravity to preload the flushing rim during a passive release stage; and a pressure tank, including:

an internal air bladder oriented within the pressure tank to compress when exposed to a water supply and expand to discharge pressurized water of the pressure tank at a higher flow rate than a water flow rate of the preloaded gravity water into the flushing rim and push the preloaded gravity water from the flushing rim into a toilet bowl during a pressure release stage.

2. The toilet of claim 1, further comprising:

a magnetic valve to selectively discharge the water from one of the gravity tank and the pressure tank.

3. The toilet of claim 1, further comprising:

a three-way flushing valve to selectively discharge the water from one of the gravity tank and the pressure tank.

4. The toilet of claim 1, wherein the pressure tank is located within the gravity tank.

5. The toilet of claim 1, wherein pressurized water flows from the pressure tank at 0.7-1.0 gallons per flush.

6. A toilet system comprising:

a toilet, the toilet including:

a toilet bowl including a flushing rim; and a toilet tank, the toilet tank including:

a gravity tank to discharge gravity water by force of gravity to preload a flushing rim during a passive release stage; and a pressure tank, including:

an internal air bladder oriented within the pressure tank to compress when exposed to a water supply and expand to discharge pressurized water of the pressure tank at a higher flow rate than a water flow rate of the gravity water into the flushing rim and push the preloaded gravity water from the flushing rim into the toilet bowl during a pressure release stage.

7. The toilet system of claim 6, wherein water flows from the pressure tank at 0.7-1.0 gallons per flush.

8. The toilet system of claim 6, further comprising:

a passive valve in the gravity tank to open and release the gravity water from the gravity tank via a passive valve channel to preload the flushing rim;

an inlet float and a pressure tank actuation float to activate vertically down in the gravity tank responsive to releasing the gravity water from the gravity tank;

a pressure tank actuation trigger assembly attached to the pressure actuation float, the pressure tank actuation trigger assembly to activate horizontally; and a magnetic valve release system to control the opening and closing of both the gravity tank and the pressure tank and selectively discharge one of the gravity water from the gravity tank and the pressurized water from the pressure tank, the magnetic valve release system including:

a magnet chassis attached to the pressure tank actuation trigger assembly and configured to rotate; and a magnetic c-ring to activate vertically downward on a sliding cylinder when exposed to an opposing magnetic field of a rotating magnet chassis, the sliding cylinder to open a channel to release gravity water or pressurized water.

9. The toilet system of claim 6, further comprising:

a three-way flushing valve to selectively discharge one of the gravity water from the gravity tank and the pressurized water from the pressure tank.

10. The toilet system of claim 9, wherein the initial pressure from the water supply is 30-40 psi, and the pressure on an internal air bladder may be 15-20 psi.

11. A method for flushing a toilet comprising:

discharging gravity water by force of gravity from a gravity tank to preload a flushing rim during a passive release stage;

compressing an internal air bladder in a pressure tank by filling the pressure tank with a water supply; and discharging pressurized water from the pressure tank at a higher water flow rate than the gravity water flow rate to push the preloaded gravity water in the flushing rim into a toilet bowl during a pressure release stage.

12. The method for flushing a toilet of claim 11, wherein the pressurized water flows from the pressure tank at 0.7-1.0 gallons per flush.

13. The method for flushing a toilet of claim 11, further comprising:

controlling the opening and closing of both the gravity tank and the pressure tank with a magnetic valve release system.

14. The method for flushing a toilet of claim 13, further comprising:

opening a passive valve in the gravity tank; and releasing gravity water from the gravity tank via a passive valve channel to preload the flushing rim.

15. The method for flushing a toilet of claim 14, further comprising:

activating an inlet float and a pressure tank actuation float vertically down in the gravity tank responsive to releasing gravity water from the gravity tank; and activating a pressure tank actuation trigger assembly horizontally, the pressure tank actuation trigger assembly attached to the pressure actuation float.

16. The method for flushing a toilet of claim 15, further comprising:

rotating a magnet chassis attached to the pressure tank actuation trigger assembly;

exposing a magnetic c-ring to an opposing magnetic field; and activating a magnetic c-ring vertically downward on a sliding cylinder.

17. The method for flushing a toilet of claim 15, further comprising:

removing a seal on the pressure tank; and releasing water from the pressure tank.

18. The method for flushing a toilet of claim 11, further comprising:

filling the pressure tank with the water supply until a predetermined threshold is reached; and discharging pressurized water from the pressure tank responsive to reaching the predetermined threshold.

19. The method for flushing a toilet of claim 18, wherein the predetermined threshold is at least one of when the internal air pressure of the internal air bladder equals the water supply pressure or when the supply toggle value disconnects the pressure tank from the water supply.

20. The method of claim 11, wherein the initial pressure from the water supply is 30-40 psi, and the pressure on an internal air bladder may be 15-20 psi.

* * * * *